8/5/86 XR 4,604,724

United States Patent [19]

Shaginian et al.

[11] Patent Number: 4,604,724

[45] Date of Patent: Aug. 5, 1986

[54] AUTOMATED APPARATUS FOR HANDLING ELONGATED WELL ELEMENTS SUCH AS PIPES

[75] Inventors: Albert S. Shaginian; Alexei G. Asan-Dzhalalov; Anatoly A. Pevnev; Alexandr P. Androsenko; Alexandr V. Suvorov; Boris V. Khalitov; Leonid N. Palkin, all of Gomel; Viktor V. Gnatchenko; Nikolai P. Makarov, both of Moscow; Valery A. Panteleev, Gomel; Nikolai I. Davidenko, Gomel; Stanislav K. Shpilevsky, Gomel; Alexandr S. Tikhonenko, Gomel; Anatoly G. Romanovsky, Gomel, all of U.S.S.R.

[73] Assignee: Gomelskoe Spetsialnoe Konstruktorsko-Tekhnologicheskoe Bjuro Seismicheskoi Tekhniki S Opytnym Proizvodstvom, Gomel, U.S.S.R.

[21] Appl. No.: 783,277

[22] Filed: Oct. 4, 1985

Related U.S. Application Data

[63] Continuation of Ser. No. 468,844, Feb. 22, 1983, abandoned.

[51] Int. Cl.[4] ..... G06F 15/20

[52] U.S. Cl. ..... 364/478; 364/422; 414/22; 175/24; 175/40; 175/52; 166/53; 166/77.5

[58] Field of Search ..... 364/421, 422, 167, 478; 414/22; 175/24, 40, 52; 166/53, 77.5

[56] References Cited

U.S. PATENT DOCUMENTS

| | | | |
|---|---|---|---|
| 3,177,944 | 4/1965 | Knights | 166/77.5 |
| 3,194,313 | 7/1965 | Fanshawe | 166/77.5 |
| 3,239,016 | 3/1966 | Alexander | 73/164 |
| 3,254,776 | 6/1966 | Brown | 414/22 |

(List continued on next page.)

FOREIGN PATENT DOCUMENTS

| | | |
|---|---|---|
| 245710 | 11/1969 | U.S.S.R. . |
| 435345 | 11/1974 | U.S.S.R. . |
| 427138 | 1/1975 | U.S.S.R. . |
| 629314 | 1/1978 | U.S.S.R. . |
| 597809 | 3/1978 | U.S.S.R. . |
| 625019 | 8/1978 | U.S.S.R. . |
| 651128 | 3/1979 | U.S.S.R. . |
| 768933 | 10/1980 | U.S.S.R. . |
| 771324 | 10/1980 | U.S.S.R. . |

OTHER PUBLICATIONS

"Digital Phase Meter Updates Measurement Each Cycle", by R. E. S. Abdel-Aal, *Electronics,* pp. 156 and 157, dated Sep. 22, 1981.

Kastrop, J. E., and Colvin W. B., "New Automatic Rig is Integrated Machine," *Petroleum Engineer International,* Mar. 1967, pp. 58–62.

*P nary Examiner*—Charles E. Atkinson

*. sistant Examiner*—John R. Lastova

*A orney, Agent, or Firm*—Fleit, Jacobson, Cohn & Price

[57] ABSTRACT

A derrick is provided with a vertically movable elevator for suspending a string of elongated well elements, such as pipes. An immovable lower support is provided for suspending the string, and an automatic tong is provided for screwing and unscrewing pipes to and from the string. A manipulator grips and delivers a pipe to an operating position in axial alignment with the well bore. A control system includes position sensors for sensing the positions of a well pipe, one of which sensors is mounted on the elevator, a second sensor is mounted on the automatic tong, and a third sensor is mounted on the manipulator. The control system also includes a programmed logical control unit, through which the sensors are connected to a drive system. The first sensor is connected to a drive for vertically moving the elevator, a drive for closing and opening grippers on the elevator, and a drive adapted to transversely move the automatic tong. The second sensor is connected through the control unit to a drive for vertically moving the elevator, and the third sensor is connected to a drive for longitudinally moving the grippers of the manipulator.

2 Claims, 30 Drawing Figures

U.S. PATENT DOCUMENTS

| | | | |
|---|---|---|---|
| 3,266,582 | 8/1966 | Homanick | 175/57 |
| 3,306,101 | 12/1964 | Holderer | 73/147 |
| 3,376,938 | 4/1968 | Scott | 173/44 |
| 3,464,741 | 10/1968 | Gheorge et al. | 175/85 |
| 3,545,313 | 10/1969 | Kelley | 81/57.34 |
| 3,612,286 | 10/1971 | Langowski et al. | 414/22 |
| 3,861,756 | 1/1975 | Arikawa | 303/21 BE |
| 4,022,284 | 5/1977 | Crow | 175/24 |
| 4,042,123 | 8/1977 | Sheldon et al. | 414/22 |
| 4,077,525 | 3/1978 | Callegan et al. | 414/22 |
| 4,347,028 | 8/1982 | Dugan | 414/22 |
| 4,382,738 | 5/1983 | Frias | 414/22 |
| 4,432,064 | 2/1984 | Barker et al. | 175/40 X |
| 4,449,592 | 5/1984 | Mayer | 414/22 |

AUTOMATED APPARATUS FOR HANDLING ELONGATED WELL ELEMENTS SUCH AS PIPES

This application is a continuation of application Ser. No. 468,844, filed Feb. 22, 1983, now abandoned.

BACKGROUND OF THE INVENTION

1. Field of the Invention

The invention relates to the art of oil well drilling and to the equipment used therefor, particularly, to automated apparatus for handling elongated well elements such as pipes especially used in well bore repairs on offshore drilling platforms.

2. Description of the Prior Art

During oil well operation there is a frequent need of carrying out preventive maintenance operations as well as special repairs which require manipulating of damaged equipment into and out of a well, the equipment including drill pipes and rods that got out of order in a drill string.

With the aim of performing these operations a mobile apparatus is erected over the well bore to generally include hoisting means, gripping and rotating means adapted to screw and unscrew the joints on a string of drill pipes or rods. Since well servicing is performed on an operating well, efficiency is very important. Well servicing time also includes the time for raising and lowering drill strings and in all instances it is desirable to reduce this time to a minimum. The quest for time reduction in performing the above operations has led to improvemets in timed coincidence of the operations, on the one hand, and also in automation of these operations. To the accomplishment of the first of the above trends there have been proposed apparatus in which not only the lowering and raising operations coincide with loading and unloading operations, but idle time and no-load lowering and raising of the equipment for suspending the string of pipes or rods have been eliminated while in some drilling installations the screwing and unscrewing of pipes and similar elongated well elements (drill-pipe stand, rods) are carried out simultaneously with continuous lowering or raising of the string composed of such elongated well elements (see, for example, U.S. Pat. Nos. 3,194,313; 3,306,101; 3,376,938; 3,404,741; 3,861,756; Soviet Inventor's Certificate No. 629,314).

However, attempts to make such apparatus economically feasible failed because the aforesaid solution inevitably involves complications in structure caused by the necessity to manipulate in parallel by at least two elongated well elements to be screwed or unscrewed to form a string. In this case the control system of the apparatus becomes substantially complicated to therefore decrease reliability of the system.

That is why alongside with the above mentioned apparatus, which may be referred to as continuous action apparatus, there are designed and find an extensive application apparatus offering lesser coincidence in the operations, such apparatus being further referred to as discontinuous action apparatus (see, for example, U.S. Pat. Nos. 3,239,016; 3,266,582; 4,042,123). In such an apparatus emphasis is mainly placed upon economy, safety, and reliability in operation, decrease in overall dimensions, especially in clear height, and specific amount of metal per structure. These qualities are especially important for operating marine wells. Thus, in designing both the continuous action apparatus and the discontinuous action apparatus there is a tendency to automate the operations as much as possible with the end of increasing operating efficiency and safety.

One of the major problems encountered while designing a fully automated apparatus is associated with different lengths of pipes or similar elements forming part of a well string. Commercially known drill pipes and rods have a length tolerance within ±50 mm. Therefore, while manipulating a single pipe or rod the position of its end may vary within 100 mm. When a string consisting of several well elements is raised in increments with each increment being equal to a rated length of a single well element, total displacement of the string end may amount to several meters, which is why the apparatus will not operate without position adjustments of its mechanisms.

The automated system disclosed in Soviet Inventor's Certificate No. 629,314; Int.Cl.[2] E. 21B 19/16, granted in 1974, and offering a continuous operation, is a solution to the problem of rendering the operating cycle automatic with due regard to different lengths of the well elements.

That automated system comprises derrick-mounted and vertically movable upper and lower means for suspending a string of well elements, the means being carriages with elevators, a manipulator for delivering a well element (a stand of pipe) from a storage means (a stand receiver) to the well bore, the manipulator comprising two rotating levers for delivering a stand of pipe, and an automatic tong having a high-torque device (a tightener wrench) arranged on the lower carriage and a low-torque device (the tong proper) mounted on a further vertically movable carriage arranged above the carriage of the upper means for suspending the well string. Each of the carriages is provided with an individual drive for vertically moving a respective carriage. The elevator, the manipulator, and the high-torque device each comprise grippers kinematically connected to drives for opening and closing the same grippers. The grippers of the low-torque device are kinematically connected to a drive for horizontally moving the same grippers. Both the elevators and the grippers of the low-torque device are vertically movable relative to the carriages on which they are mounted.

The control system of that automated system comprises carriage position sensors, sensors for sensing the position of the elevators relative to the carriages, sensors for sensing the position of the grippers on the well axis, sensors for sensing the position of the grippers, sensors for sensing the position of a well element in the string (these are sensors for sensing the presence of a stand lock as disclosed in the specification of the Inventor's Certificate). All the above mentioned sensors are connected through a control device with the respective drives of the above disclosed mechanisms of the automated system.

The control system provides for continuous lowering or raising of the well string by the movable elevators which in turn take up the weight of the string, while the screw is tightened or loosened by the high-torque device and screwed and unscrewed by the low-torque device at the same time as the elevators move vertically. A further stand of pipe is simultaneously delivered from the stand receiver to the grippers and in the opposite direction. The displacement of the upper end of the string and the lower end of the stand of pipe to be connected to or disconnected from the upper end of the string is compensated by the movement of the elevators relative to respective carriages and by the vertical displacement of the grippers of the low-torque device relative to its carriage. One of the sensors serves to sense the presence of a stand lock in the grippers of the device. A similar sensor is provided on the upper elevator and controls withdrawal of the grippers of the low-torque device, which hold an unscrewed stand, from the well axis as the string is raised or produces a control signal for halting the same grippers, which hold a stand to be screwed, on the well axis as the string is lowered.

Thus, the just described automated system offers improved efficiency in lowering and raising drill string elements due to both an extensive use of automation and to coincidence in time of the most operations performed by the system. As can be seen, however, even from this simplified description, this automated system has a complicated structure due to a great number of movable units, such as carriages, elevators, a tong, a respective number of drives, and a great number of control instruments. As a result, the system is cumbersome, its specific amount of metal is great and so is the weight, on the one hand, and on the other hand, it has inevitably inadequate reliability in operation. Also, these same features in combination with a relatively high derrick, which in this construction should measure more than two lengths of a well element, render this system inappropriate for use on offshore drilling platforms due to a limited floor area on such platforms and a limited supply of repair means, as well as due to the requirement of increased stability of the platform intended to support this system.

The above problem of compensating unequal lengths of well elements was repeatedly a major obstacle in achieving complete automation in the discontinuous action systems, which are structurally simpler than the one just described. In search of the ways to a solution of this problem, AUTOMATIC DRILLING MACHINES, INC. decided to order a special-gage drill string consisting of pipes equal in length, or more precisely, of pipes made to close tolerances for length.

An automated drilling apparatus designed by the above company, which can be simultaneously used for performing both lowering and raising operations in repairs, comprises an upper means and a lower means both for suspending a drill string, an automatic tong for screwing and unscrewing the well elements, and a manipulator for delivering a well element to an operating position along the well bore axis. The upper means is a drill bit mounted on the derrick for vertical movement and kinematically connected to a respective drive constructed as a hydraulic hoisting system. The drill bit operates as a low-torque device of the automatic tong, the other part of which is represented by mechanisms arranged in a chuck of a suitable design. Three sets of grippers are arranged in the upper portion of the chuck together with a drive for closing and opening the same grippers and with a rotary drive operate as a high-torque device, while the remaining grippers together with the drive for closing and opening the grippers operate as a locking device. The lower means for suspending the drill string is represented by a spider having wedge-shaped grippers (a pipe holder) and assembled under the chuck. The manipulator is a shift lever rotatable in a vertical plane, provided with power grippers and with a drive for effecting movement of the lever both ways in an operating position (horizontal) and in an operating position (vertical).

The apparatus also comprises an automated pipe racking stand for storing drill pipes in a horizontal position. The pipe racking stand is provided with storage racks arranged at both sides from the manipulator and constructed as magazines having rows of vertical posts to accomodate the pipes therebetween so that their axes are parallel to the axis of a pipe gripped by the grippers of the manipulator when the latter is in a horizontal position.

Cranes serves as a transfer device to transfer pipes from the pipe storage racks to the manipulator. Each crane comprises a movable member which can move in both a vertical and horizontal planes. The movable member is a transverse-piece installed in horizontally extending guides for movement perpendicularly to the pipe axis (a transverse direction) and supporting a beam having grippers, the beam in turn being suspended on a leverage for movement up and down. For performing all kinds of movements there are drives provided in the apparatus. The pipe storage racks are arranged on individual trailers. The drives of the apparatus are hydraulically operated. The control system comprises a programmed logical control unit having an input terminal connected to the sensors and to a control console, and an output terminal connected to a system of electrically controlled actuators which set in motion the drives of the apparatus (see J. A. Castrop, U. B. Colwin "Avtomatizirovannaya burovaya ustanovka s gidravlicheskoi gruzopodyomnoi sistemoi", U.S. monthly "Inzhener-neftyanik"/Russian translation/, No. 3, 1967, p. 29–36).

The apparatus is a small-bulk arrangement both in height (under 12 m) and in floor area, and it is simple in construction and extensively automated to provide practically automatic operation. However, while manipulating a string of drill pipes, positioning of the string in the chuck, requiring a strict matching of jaws with the lock of the string, has to be adjusted from the control console. In order to determine the misalignment of the end of the string in the chuck there is a TV camera provided in the apparatus with a TV screen on the control console.

The special-gage drill string consisting of pipes equal in length renders the apparatus expensive and inconvenient in repairs. On the other hand, utilization of conventional pipes would impede efficiency because some operations in lowering and raising the pipes would have been carried out under normal control. This in turn would risk reliability and safety to thereby make the control of the apparatus dependent on the skill, experience, and psychological characteristics of the operator.

A disadvantage of the apparatus also resides in the fact that some conventional pieces of equipment (e.g. an automatic tong) used therein are of special design, which accounts for a high cost of production.

Also, the fact of utilizing cranes as a means for transferring pipes from the storage racks to the manipulator and back accounts for awkwardness and high specific amount of metal per automated pipe racking stand, while the storage rack per se, though simple in construction, impedes control of the pipe racking stand, which control is to provide variations in positioning of the grippers of the transfer device in a two-dimensional coordinate system.

Moreover, the automated pipe racking stand is inconvenient for transportation since an additional vehicle is required.

Furthermore, the storage rack design offers accomodation for pipes of one and the same diameter. Pipes of a different diameter may be accomodated after changing the magazines.

SUMMARY OF THE INVENTION

The main object of the invention is the provision of an economically feasible and simple in construction automated apparatus for handling elongated well elements, such as pipes, which offers higher efficiency, convenience, and safety due to the exclusion of manual labor in handling elongated well elements having different lengths.

Another object of the invention is the provision of an automated apparatus for handling elongated well elements, such as pipes, having a control system which is reliable and simple in construction.

A further object of the invention is the provision of an automated apparatus for handling elongated well elements, such as pipes, wherein efficiency is enhanced due to the exclusion of manual labor when repeated operations for tightening or loosening screw joints in the drill string are required.

Among the main objects of the invention is the provision of an economically feasible and simple in construction automated apparatus of the kind specified featuring storage facilities for elongated well elements, which offers high efficiency, convenience, and safety due to the exclusion of manual labor in handling elongated well elements having different lengths.

Still another object of the invention is the provision of an economically feasible, simple in construction, and low-bulk automated pipe racking stand for horizontally accomodating elongated well elements in an apparatus of the kind specified.

Another object of the invention is the provision of an automated pipe racking stand having an improved storage rack which facilitates transportation of the pipe racking stand.

Yet another object of the invention is the provision of an improved automated pipe racking stand for horizontally accomodating elongated well elements, which may be readily adjusted for accomodation of well elements of a different diamater.

The invention consists in the provision of an automated apparatus for handling elongated well elements, such as pipes, made up in a drill string by means of screw joints and comprising an upper means both for suspending the drill string, an automatic tong for screwing and unscrewing the well elements, and a manipulator for delivering a well element to an operative position. All the above-mentioned units have clamping means with grippers and drives for opening and closing the grippers. The automatic tong comprises at least one rotation drive kinematically connected to the clamping means of the tong. The apparatus also comprises drives, one of which is kinematically connected with the upper means for suspending a drill string and is used for imparting vertical motion to this means to move along the derrick on which it is assembled, while the other drive is kinematically connected with the manipulator and is used for moving the manipulator from an inoperative position to an operative position when the axis of a well element grasped by the grippers of the manipulator coincides with the axis of the well bore. The control system of the apparatus comprises a programmed logical control unit electrically connected to the control console and controlling the drives of the units of the apparatus through a system of electrically controlled actuators. The control system also comprises sensors electrically connected to the logical control unit.

According to the invention the automatic tong is arranged between the manipulator in an operative position and the lower means for suspending a drill string. The automatic tong is movable (in the direction perpendicular to the axis of the string) from an inoperative position to an operative position where the axis of the opening formed by the grippers in a closed position coincides with the axis of the well bore. In order to effect this motion there is a drive provided in the apparatus. Among the sensors of the control system there are sensors for sensing the position of the upper means for suspending the drill string, of the automatic tong, and of the manipulator as well as sensors for sensing the position on the grippers of the same units and of the lower means for suspending a drill string. Also, the control system comprises first, second, and third sensors for sensing the position of a well element in the string, all the sensors being electrically connected to the programmed logical control unit. The first sensor is mounted on the upper means for suspending a drill string and is used to actuate through the logical control unit the drive for vertically moving the upper means for suspending a drill string, the drive for closing and opening the grippers of the upper means, and the drive for transversely moving the automatic tong. The second sensor is mounted on the automatic tong and is used for actuating the drive for vertically moving the upper means for suspending the drill string. The third sensor is mounted on the manipulator, in which the grippers are, according to the invention, movable along the axis of the opening defined by these grippers in a closed position and kinematically connected to the drive for producing such motion. The third sensor is used to actuate the drive for longitudinally moving the grippers of the manipulator.

Such arrangement of the apparatus of the invention provides not only for the assignment of the length of travel of the upper means for suspending the drill string, but also for regulation by the first and the second sensors, which set portions of the upper means at elevations in response to positions of the upper end of a wall element and of the screw joint connecting adjacent well elements. The position of the lower end of the well element to be connected to the string prior to the operation of the automatic tong is determined by the third sensor through the movement of the grippers of the manipulator. This arrangement provides for complete automation of the apparatus irrespective of the length of the well elements. The structural features of the apparatus tolerate wide margins in the length of the well elements, which exceed allowances for length, and these may be advantageously used in composing a drill string from drill pipes or rods having different dimensions, and in either case commercial pipes and rods may be utilized without resort to manual control of tripping operations.

Such operation of the apparatus of the invention is responsible for increased efficiency, reliability, and safety. The fact that the apparatus may handle conventional pipes and can be assembled, due to its design, from conventional units, such as elevators, spiders, and automatic tongs, makes the venture economically feasible. Since the units forming part of the operators are structurally simple the control system is naturally simple too.

Due to the combination of features set forth the apparatus of the invention may be utilized with any storage means that accomodate elongated well elements both in vertical and horizontal positions. Moreover, the apparatus can handle drill pipes, tubing, pumping rods, and connectors for composing strings of pipes or rods without any change in construction and with limited adjustment.

The programmed logical control unit of the control system of the apparatus can comprise:

an instruction coding means for specifying the sequence of the codes of instructions sent to respective blocks in accordance with a preset sequence; a displacement program block for specifying the first program for bringing the actuators into operation in accordance with the codes of instructions coming thereto, and producing a signal for switching on the power amplifiers of the actuators; a timer producing a signal at the moment of termination of the time which is determined by the instruction code specified by said instruction coding means; a wait program block for specifying the second program, which determines the codes of instructions resulting in operation of corresponding sensors, followed by changing a setting of said instruction coding means; a clock program block for specifying the third program, which determines the codes of instructions that end on the expiration of a preset time, followed by changing the setting of said instruction coding means; a sensor program block for specifying the second program, which determines the codes of instructions resulting in operation of corresponding sensors, and the fourth program, which determines the codes of instructions resulting in operation of corresponding sensors with control of the time of execution of the current instruction, followed by changing the setting of said instruction coding means; a commutator for producing output signals depending on selective switching-on of said timer, wait program block, and clock program block; a clock driver corresponding to the signals from the sensor program block and producing single signals for resetting the instruction coding means; a trigger shaper for producing signals controlling engagement and disengagement of the displacement program block, the sensor program block, and the timer in response to the output of the commutator; and an indicating unit responsive to the output of the instruction coding and means for delivering information indicative of carrying out a corresponding command to the indication panel of the control console.

With such an arrangement of the program logical control unit the control system produces some commands in response to the output of the sensors and the other commands are produced in response to the time of carrying out the previous commands. Also, in critical situations the commands may be produced in response to the output in the sensors with time adjustment to thereby provide a highly reliable and maneuverable control system.

With a view of providing a structurally simple and compact device it is advantageous to provide the control system with separate control units, each of which is adapted to control a set of functionally interconnected and closely positioned drives. There is also provided a unit for controlling the process of handling drill rods or pipes, which may be functionally associated with the drive for vertically moving the upper means for suspending a drill string, the drive for closing and opening the grippers of the same means, and the drive for closing and opening the grippers of the lower means for suspending a drill string. The control system comprises a unit for controlling the automatic tong which may be functionally associated with the drive for closing and opening the grippers of the clamping means of the tong, the rotation drive, and the drive for transversely moving the tong. The manipulator control unit may be functionally associated with the drive for closing and opening the grippers of the manipulator, the drive for longitudinally moving the same grippers, and the drive for moving the manipulator. With this arrangement the first sensor for sensing the position of a well element in the drill string should be electrically connected to the unit for controlling the process of handling drill rods or pipes and the unit for controlling the automatic tong, the second sensor for sensing the position of a well element should be electrically connected to the unit for controlling the process of handling drill pipes or rods, while the third sensor should be electrically connected to the manipulator control unit. With this arrangement of the control system each of said control units should have the above described programmed logical control unit.

The above control system makes it possible to separately control single units of the apparatus, which is convenient for operation under manual control, in adjustment and repairs.

A preferred embodiment of the invention may take the form wherein at least one of the sensors for sensing the position of a well element is an inductive differential sensor including an excitation winding and an output winding and a corresponding control unit should comprise a device for determining phase shift electrically connected to the output winding of this sensor and delivering a signal to the programmed logical control unit of a corresponding control unit each time the inductance between the excitation winding and the output winding changes. Specifically, the first sensor for sensing the position of a well element may comprise a further output winding connected in opposition and in series with the first output winding and both the output windings may be axially aligned with the excitation winding in planes parallel to the excitation winding on both end sides thereof. Such arrangement makes it possible to put the windings of the sensor on a cylindrical core that is the simplest to manufacture.

The second sensor for sensing the position of a well element may comprise the excitation winding and the output winding arranged so as to form a passage for the drill string, the excitation winding being disposed in a plane perpendicular to the axis of the well bore, while the output winding being disposed in a plane parallel to this axis.

Such an arrangement of the sensor is dictated by the necessity of a relative lateral movement of the automatic tong and the manipulator with a pipe or rod grasped by the grippers thereof, otherwise a closed-in-plan configuration of the sensor would be an obstacle to such motion.

When the apparatus is utilized for handling pipes there may be used an automatic pipe tong comprising a high-torque device, a low-torque device, and a locking device each having an individual clamping means with grippers and a drive for closing and opening the grippers. The high-torque device comprises a first rotation drive for loosening the screw as the drill string is raised from the well bore and for tightening the screw as the drill string is lowered, and the low-torque device comprises a second rotation drive for unscrewing and screwing the well elements respectively.

The automatic tong as well as the derrick with the elevator mounted therein and constituting a substantial part of the upper means for suspending a drill string may both be mounted on a first base, while the manipulator may be mounted on a second base. With this arrangement the spider constituting the lower means for suspending a drill string should be mounted immovably over the well head.

The control system may incorporate elevator position sensors mounted on the derrick for producing signals carrying information that the elevator is in one of its three positions, the signals being supplied to control units for bringing the elevator to a stop at a desired position and moving the automatic tong in a desired direction; an automating tong position sensor mounted on the automatic tong for producing either an "Approached" signal or a "Withdrawn" signal, both signals corresponding to operative and inoperative positions of the tong, respectively, and delivered to control units for moving the elevator in a desired direction and bringing the tong to a stop in a desired position; a manipulator position sensor mounted on the manipulator for delivering to control units either an "Approached" signal or a "Withdrawn" signal, both signals corresponding to operative and inoperative positions of the manipulator, respectively, for moving the elevator in a desired direction and bringing the manipulator to a stop at a desired position; an elevator-spider position sensor operatively connected with the grippers of the elevator and the spider for delivering either an "Open" signal or a "Closed" signal to control units, of which signals the former corresponds to the grippers of the elevator in an open position and the grippers of the spider is a closed position, while the latter corresponds to a closed position of the grippers of the elevator and an open position of the grippers of the spider, these signals being used to move the elevator in a desired direction, a manipulator position sensor operatively connected with these grippers and intended for delivering either an "Open" or a "Closed" signal to a control unit for actuating the second drive for rotating the automatic tong; sensors for the high-torque and the low-torque devices of the tong which are mounted on these devices and intended for delivering signals to an automatic tong control unit for bringing the first and the second rotation drives respectively to a stop; pipe position sensors of which the first one is mounted on the elevator, the second is on the automatic tong between the high-torque device and the locking device, and the third sensor is mounted on the manipulator, the first and the third sensors being responsive to the end of a pipe appearing within the sensing limits of the sensors while the second sensor being responsive to the appearance of a screw connector making the string. The first pipe position sensor is intended to produce signals in response to which corresponding control units actuate corresponding drives, stop the elevator at a desired position, and move the automatic tong in a desired direction. Also, in response to the signal of the first pipe position sensor, the tong control unit provides a command for closing the grippers of the locking device of the automatic tong. The second pipe position sensor is intended to produce a signal in response to which a corresponding control unit stops the elevator at a desired position. The third pipe position sensor is intended to produce a signal in response to which a corresponding control unit stops the longitudinally movable grippers of the manipulator at a desired position.

With such an arrangement of the apparatus, the operation thereof in an automatic cycle is possible with a relatively small number of sensors, an overwhelming number of which are used to drive the control units for delivering various commands not only within different control cycles (raising and lowering a drill string), but within a single control cycle. Apart from being simple and reliable this arrangement has an advantage of providing coincidence in time of the commands enabling parallel operations of raising and lowering a drill string, on the one hand, and removing the drill pipes from the well zone and delivering them to the well zone, on the other hand.

In a specific modification of the apparatus having all the drives connected to hydraulic operation and interconnected to provide a hydraulic circuit, including a hydraulic power source, delivery and drain lines, and reversible valve spools, the sensor of the position of the grippers of the elevator-spider may be operatively connected with a normally closed check valve provided in the delivery line connecting the hydraulic power source with the reversible valve spool actuating the drive for closing and opening the grippers of the elevator, in this case the drive for closing and opening the grippers of the spider should be provided with a stop mechanically interacting with the check valve so that the latter shuts off the above mentioned valve spool from the delivery line when the grippers of the spider are opened to thereby prevent opening of the elevator grippers.

With such disposition the above sensor provides a signal indicative of the position of the grippers of both the elevator and the spider which are coupled by means of a simple and smoothly operating locking system which ensure holding a drill string suspended, thereby providing for safety in operating the apparatus.

Among the operations carried out on the apparatus the most labour consuming and critical one is the operation of screwing and unscrewing a drill string by the automatic tong. This operation is complicated to carry out under automatic control due, among other things, to non-uniform and frequently poor state of screw threads on the connectable portions of the well elements. Due to various defects, such as rust, and forces and time for tightening and loosening, the screw joints may be greater than is set by the operational program. That is why it is imperative that the control unit for controlling the automatic tong comprise a control signal conditioner and a recycle instruction coding means electrically interconnected and switched in the circuit of the programmed logical control unit for producing a predetermined number of signal for controlling a reverse action and actuating in the previous direction of the instruction coding means in the programmed logical control unit when the latter produces a signal indicating the lapse of predetermined time from the moment of producing, in the same unit, a signal for actuating the first drive for rotating the automatic tong.

If the screw joint does not become loosened (in unscrewing the joint) at the first attempt, the automatic tong will repeat the effort until the required conditions are attained or the number of attempts get equal to that for which the recycle instruction coding means is preset. When this number of attempts is exhausted the system will come to a standstill and the operator will see to it that the apparatus resumes operation.

In the apparatus of the invention constructed according to the modification providing a horizontal storage means for pipes or rods the second base may support the above described manipulator, a storage rack having shelves for accomodating well elements (drill pipes or rods) in a horizontal position and in parallel to the axis of the opening formed by the closed grippers of the manipulator, and a device for transferring a well element from the storage rack to the manipulator and back, which device comprising a movable member provided with grippers and movable in a plane perpendicular to the axis of the opening formed by the closed grippers of the manipulators positioned horizontally. The movable member carries a drive for closing and opening the grippers thereof. The control system of the apparatus should be provided with a control unit for controlling loading and unloading operations through the above-described drives, and a sensor for sensing the position of the grippers of the transfer device which is connected to this unit and to the manipulator. This sensor is designed for producing signals in response to which the above mentioned control units issue commands for moving the transfer device from the storage rack to the manipulator and backwards, closing and opening the grippers of the manipulator and moving the latter into operating position.

The described interrelation of the manipulator, the storage rack, and the well element transfer device, which makes it possible to load and unload drill pipes and rods in a transverse direction, excludes the effect of the length of drill pipes and rods on the amount of travel of the movable member of the transfer device. A deviation in length of the well elements transferred to compose a drill string is compensated for by longitudinal mobility of the manipulator grippers.

In this arrangement the third well element position sensor, which controls longitudinal movement of these grippers, provides for an invariable starting position of the string facing end of a drill pipe or rod while the string is being screwed with the manipulator in an operating position. The control system of the apparatus provides interconnection of the transfer device and the manipulator and a synchronism of the lowering and raising operations with the loading and unloading operations.

The invention also resides in the provision of an automatic pipe racking stand of an automated apparatus for handling elongated well elements, such as pipes, made up in a drill string by means of screw joints. The automatic pipe racking stand comprises a platform, a storage rack for accomodating well elements in a horizontal position, a manipulator for delivering a well element to the well bore mounted on the platform for rotation from a horizontal inoperative position to a vertical operative position, and vice versa, and kinematically coupled to a suitable drive, a transfer device for transferring a well element from the storage rack into the manipulator, and vice versa, and a control system including control units and sensors. The manipulator and the well element transfer device are provided with grippers and drives for closing and opening the grippers. The transfer device includes a movable member driven by a suitable drive.

According to the invention the storage rack comprises shelves mounted on substantially vertical columns assembled on the platform for movement between an inoperative position and an operative position under the action of a suitable drive. The grippers of the manipulator are movable in a longitudinal direction and kinematically connected to a drive for longitudinally moving the same grippers. The movable member of the transfer device is at least one boom mounted for rotation in a vertical plane, and supporting grippers. The control system comprises a control unit for controlling the manipulator, the drive for longitudinally moving the grippers of the manipulator, the drive for closing and opening the grippers, and the drive for moving the manipulator between an inoperative horizontal position, and a operative vertical position and vice versa, and a control unit for controlling loading and unloading operations, the drive for closing and opening the grippers of the well element transfer device, the drive for rotation the boom of the latter device, and the drive for moving the shelves to an operative position, an a control unit for controlling loading and unloading operations that includes an electrically interconnected well element instruction coding means and a shelf instruction coding means.

The control system of the pipe racking stand comprises sensors which are the position sensors arranged in the ways of movement of the manipulator, the transfer device, and the rack shelves; the sensors for sensing the position of the manipulator grippers and of the transfer device, and the sensor for sensing the position of a well element mounted on the manipulator.

The pipe racking stand of the construction set forth may be utilized both in the above described automated apparatus for handling well elements and in automated apparatus of the same application but differing in structure. The pipe racking stand does not require readjustment for drill pipes and rods differing in length and in changing over for pipes and rods of a different diameter, re-setting of the number of well elements is only required in the instruction coding means of the well elements in accordance with the dimensions of the shelves which are to receive the pipes or rods.

The described construction of the storage rack makes it possible to provide a well element transfer device which is simple in construction and has a reduced amount of metal per structure to thereby make the automatic pipe racking stand compact. Also, to provide a single-coordinate (in height) shift of the grippers of this device, as the shelves of the rack receive or dispense well elements, a simpler control system was required.

With the end to provide a structurally simple storage rack it is advantageous that each shelf of the rack comprise at least two supports each including a bush put on a column and a strip member rigidly connected to the bush and substantially perpendicular to the column. The inner surface of the bush may have a straight-line groove extending along the generatrix of this surface, and a curved groove extending in a helix and having a length equal to a section of one turn of the helix, at least one of the columns being hollow and having two radial slots; while the drive for setting the shelves to an operative position comprises at least one power cylinder movably installed in the hollow column and provided with two radially disposed cylindrical pins extending through the slots in the column and beyond the outer surface of the same column. The pins of the power cylinder should be fitted so that one of them enters the curved slot of the bush of one of the shelves when the power cylinder makes a stroke reaching the shelf elevation, while the other pin enters the straight-line groove in the bush of a higher shelf.

This arrangement provides for rotation of the support of the first of the shelves and for locking the support of the second shelf.

The shelves assume either an operating position or a non-operating position by rotating individual supports of these shelves, which feature makes the rack require less floor area because several rotation movements may be done in opposing directions. Also, the rack is a compact structure due to the design of the drive for rotating the supports of the shelves. This leads to smaller dimensions and a lesser amount of metal per pipe racking stand.

To facilitate removal of the pipes and rods from the storage rack and placing them back, the rack may comprise supporting bars mounted on the platform for rotation about the axis aligned with the axis of rotation of the bottom of the transfer device with free ends of the strip members of each shelf being provided with rigid stops, which arrange circumferentially about the axis of rotation of the supporting bars when the shelves are in an operative position. To produce such rotation there may be provided a means for rotating and locking the supporting bars.

Such an arrangement permits motion of the pipes or rods on the rack by gravity, and in order to readjust the storage rack from a delivery mode, of operation to a reception mode and vice versa, it is sufficient to slightly turn the free ends of the supporting bars either downward or upward by the rotating and locking means to thereby set the pipes or rods in rolling motion toward the stop, or in the reverse direction.

To facilitate transportation of the pipe racking stand, it is worthwile that each supporting bar be made sectioned and comprise a supporting beam with one of the columns secured thereto, and a pivot shackle connected to the supporting beam by means of a pivot pin having an axis extending at right angles to the axis of rotation of a respective supporting bar. This ensures rotation of the supporting beams from an operative position to a transport position. To effect this rotation the storage rack should comprise a means for rotation and locking the supporting beams in both an operative positions and transport.

The rack is the most compact, and correspondingly of small overall dimensions and amount of metal per rack structure, when the drill pipes or rods may be placed on the shelves thereof as a compact spaceless formation. However, in this case, special requirements are placed upon the design of the transfer device. To meet these requirements the boom of the transfer device should be made telescopic and should comprise the drive for moving the front portion thereof supporting the grippers between a retracted position and an extended position. In this arrangement one of the grippers should be longitudinally spring-loaded while the other one should be mounted on the front portion of the boom for transverse movement thereon. The drive for closing and opening the grippers may comprise a power cylinder installed in the front portion of the boom, and a copying device consisting of a master cam rigidly connected to a transversely movable gripper of the transfer device, and a follower longitudinally movable in the boom and kinematically connected with the power cylinder.

Such an arrangement of the boom of the transfer device makes it possible to unload the rack with the pipes or rods tightly placed on the shelves of the rack. In this construction the longitudinally spring-loaded gripper abuts against an adjacent drill pipe or rod to be withdrawn from the rack and holds the same in place, whereas the transversely movable gripper pushes the drill pipe or rod, which is to be grasped, to urge the same against the immovable gripper and thereafter retract the boom which carries the grasped well element while the adjacent drill pipe or rod falls under gravity into the position previously occupied by the former pipe or rod.

In addition to being compact, the automatic pipe racking stand of the invention may be readily readjusted due to tight placement of the pipes or rods, since there is no need to rearrange or regulate anything on the rack.

The automatic apparatus incorporating the pipe racking stand, as have been described in the previous portions of the specification, is a preferred embodiment of the invention. The apparatus herewith has a unitized control system wherein all the sensors are electrically connected with the sensor program unit of the above described programmed logical control unit, whereas the electrically interconnected units such as the well element instruction coding means and the rack shelf counter are switched in circuit with the programmed logical control unit and with the control panel of the control console. The control system provides automatic operation of the apparatus of the invention, wherein the time for raising and lowering operations coincides with the time for loading and unloading operations.

BRIEF DESCRIPTION OF THE DRAWINGS

Now the invention is described by way of example with reference to the accompanying drawings, in which:

FIGS. 6*a* and *b* are enlarged, 90° displaced views along the arrow B in FIG. 1, FIG. 6*a* being a view of a rack in an operative position while

FIGS. 9*c* and *d* represent removal of a well element from the rack (in FIG. 9*c* the grippers are opened, in FIG. 9*d* the grippers are closed);

DETAILED DESCRIPTION OF A PREFERRED EMBODIMENT OF THE INVENTION

Figure 1:
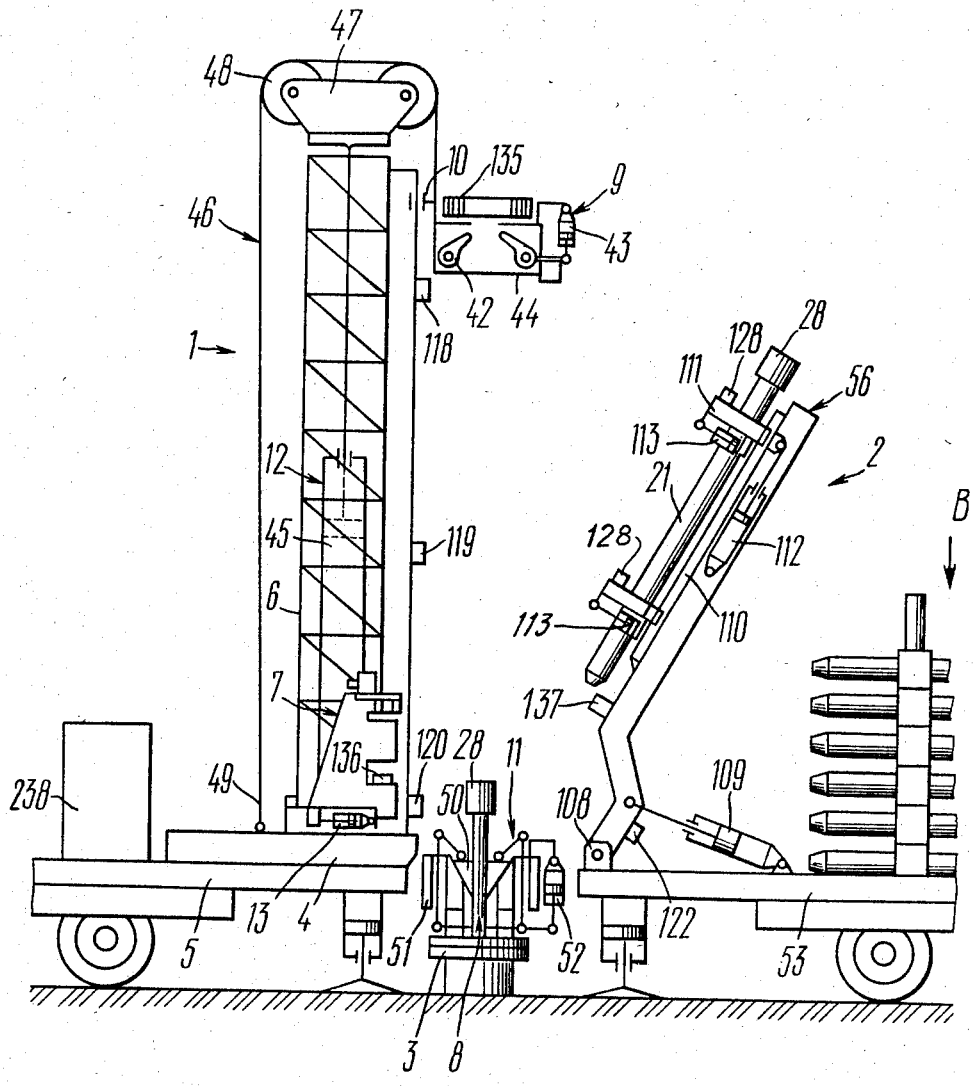
FIG. 1 is a diagrammatical representation of an automated apparatus for handling well elements, such as pipes, constructed in accordance with the invention.

The invention is now specifically described as embodied in an automated apparatus for handling tubing and sucker rods.

This apparatus (FIG. 1) comprises a well element handling device 1 and a racking stand 2, mounted near a head 3 of a well.

The well element handling device 1 comprises a first base 4 mounted on a platform 5 of a vehicle, a derrick 6, and an automatic tong 7, mounted on the first base 4, and two means for suspending a string 8 of pipes or rods, said means being disposed along the axis of the well. The upper of these two means is an elevator 9 mounted on a carriage 10 installed on the derrick 6 for vertical movement, while the lower means is a spider 11 immovably mounted above the head 3 of the well.

Additionally, the well element handling device 1 comprises a drive 12 for vertically moving the upper means for suspending the string 8 and a drive 13 for transversely displacing the automatic tong 7.

The derrick 6 is a conventional metal structure such as a girder. To be easily transported, it is mounted on the first base 4 for rotation from an operating vertical position to a non-operating (transport) horizontal position and vice versa, for which purpose there is provided a corresponding drive (not shown).

The automatic tong 7 is intended for screwing and unscrewing the string 8 of pipes or rods and, depending on the type of these elongated objects, is an automatic pipe tong or an automatic rod tong.

Figure 2:
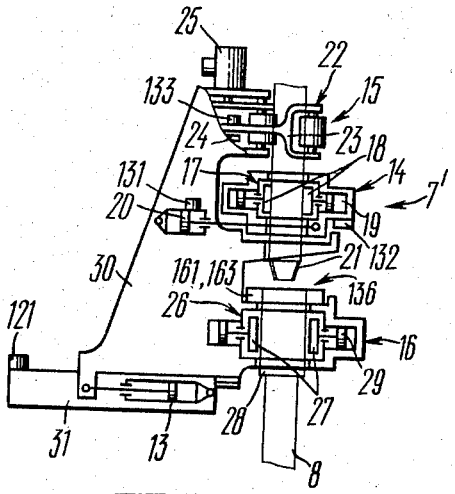
FIG. 2 is a diagrammatical representation of an automatic tong for screwing and unscrewing drill string composed of pipes in the apparatus of the invention.

FIG. 2 schematically shows an automatic pipe tong 7' which comprises a high-torque device 14, a low-torque device 15, and a locking device 16.

The high-torque device 14 is intended for loosening or final tightening of a screw joint and comprises a first clamping means 17 whose oppositely-movable grippers 18 are kinematically connected with a drive 19 for closing and opening said grippers. The high-torque device 14 also comprises a first rotation drive 20 to rotate a pipe 21 being screwed or unscrewed within a limited angle. This drive is kinematically connected with the first clamping means 17.

The low-torque device 15 is intended to completely unscrew or preliminarily screw a screw joint and comprises a second clamping means 22 having oppositely-movable grippers 23 in the form of levers with clamping rollers, and a drive 24 for closing and opening said grippers 23, kinematically connected therewith. The low-torque device 15 comprises a second rotation drive 25 having driving rollers intended to impart rotation to the pipe 21 pressed to the rollers by the grippers 23. Thus the clamping rollers of these grippers turn out to be kinematically connected with the driving rollers through the pipe 21. With other possible modifications of the low-torque device 15, the kinematic connection between the drive 25 and the clamping device 22 can be realized directly.

The locking device 16 is intended to prevent the turning-through of the string 8 during unscrewing or screwing the pipe 21 and comprises a third clamping device 26 whose oppositely-movable grippers 27 serve to envelop the end of the string 8 being connected with the pipe 21 through the outer surface of a threaded sleeve 28. The grippers 27 are kinematically connected with the drive 29 for closing and opening said grippers 27.

The grippers 18, 23, and 27 of the three clamping devices 17, 22, and 26 of the automatic pipe tong 7' are disposed so that the openings formed by closed grippers are coaxial. The devices 14, 15, and 16 are mounted in a common housing 30 of the tong 7' so that the locking device 16 with the third clamping means 26 is below, and the high-torque device 14 with the first clamping means 17 is between the low-torque device and the locking devices 15 and 16.

To transversely move the automatic pipe tong 7' between the non-operating position and the operating position thereof (in the latter case the axis of openings formed by the grippers 18,23, and 27 when being closed coincides with the axis of the well), there is provided a slide 31 secured to the first base 4. The drive 13 for transversely displacing the tong 7' is mounted in this slide and kinematically connected with the housing 30.

A preferred embodiment of automatic pipe tong 7' is described in more detail in our application "Automatic tong for screwing and unscrewing a pipe string", Ser. No. 468,485, filed Feb. 22, 1983, which is co-pending with this application.

Figure 3:
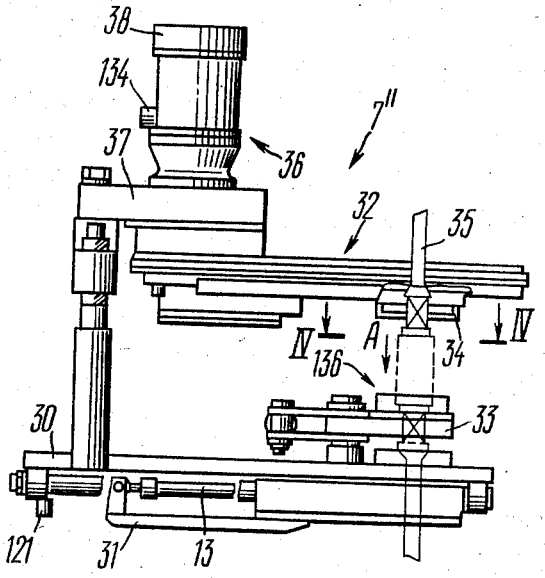
FIG. 3 is a diagrammatical representation of an automatic tong for screwing and unscrewing drill string composed of rods in the apparatus of the invention.

FIG. 3 shows an automatic rod tong 7'', which includes a swivel head 32 and a locking device 33.

Figure 4:
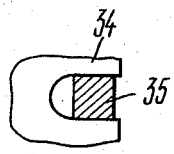
FIG. 4 is an enlarged sectional view along the line IV—IV in FIG. 3.

The swivel head 32 comprises a clamping means 34 made in the form of a movable fork (FIG. 4) moved upon the square journal of a rod 35 being screwed or unscrewed, and a rotation drive 36 (FIG. 3) kinematically connected with the clamping means 34. The rotation drive 36 includes a reduction gear 37 whose driven gear is connected with the above fork, and a motor 38.

Figure 5:
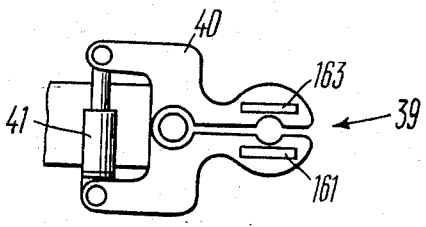
FIG. 5 is an enlarged view along the arrow A in FIG. 3.

The locking device 33 comprises a clamping means 39 whose grippers 40 (FIG. 5) are intended to embrace the journal of the rod, which is at the end of the string 8 with which rod 35 is connected or from which it is unscrewed. To close and to open the grippers 40, there is provided a drive 41.

The swivel head 32 and the locking device 33 are mounted on a common housing 30 (FIG. 3) installed on the slide 31 wherein the drive 13 for transversely displacing the automatic tong is disposed, which drive is kinematically connected with this housing.

A preferable embodiment of the automatic rod tong 7'' is described in more detail in our application "Automated apparatus for handling elongated well elements", Ser. No. 468,485, filed Feb. 22, 1983 which is co-pending with this application.

The automatic pipe tong 7' and the automatic rod tong 7'' may be variously constructed. It will be understood that in any embodiment such a tong will be provided with at least one clamping means and one rotation drive.

The elevator 9 (FIG. 1) is a conventional pipe or rod elevator and comprises a clamping means with grippers 42 which serve to embrace the string 8 by the lateral surface of the pipe of said string or by the journal of the rod of the string. When the string 8 is suspended by means of the spider 11, the elevator 9 may be used for suspending a separate pipe 21 or rod 35 (to be or being connected to the string 8. Mounted on a cross-piece 44 of the elevator 9 is a drive 43 for closing and opening the grippers 42 and it is kinematically connected therewith.

The elevator 9 is kinematically connected with the drive 12 for vertically moving the upper means through the carriage 10 carrying this elevator.

The drive 12 includes a hydraulic cylinder 45 mounted within the derrick 6 on the first base 4, and a cable-and-pulley system 46. The system 46 includes a cross-piece 47 provided with pulleys 48 and mounted on the rod of the hydraulic cylinder 45, and a cable 49 sensing around the pulleys 48 and secured with one of its ends to the first base 4, and with the other of its ends connected with the carriage 10.

The spider 11 is a conventional pipe or rod spider and comprises a clamping device with grippers 50 which may be structurally similar to the grippers 42 or be of any other construction (in FIG. 1 the grippers 42 are lever grippers, and the grippers 50 are wedge grippers). Mounted on a housing 51 of the spider 11 is a drive 52 for closing and opening the grippers 50, said drive 52 being kinematically connected with said grippers 50.

The pipe racking stand 2 of the apparatus of the present invention comprises a second base 53 which is a bed of a trailer of a vehicle, a storage rack 54 and a storage rack 55 (FIGS. 6*a* and 6*b*) for storing, respectively, the pipes 21 and the rods 35 (FIG. 3), mounted on the second base 53 (FIG. 1), a manipulator 56 to deliver the pipes 21 and rods 35 (FIG. 3) to an operating position in a well (FIG. 1) mounted on the same base for rotation from a horizontal non-operating position to a vertical operating position and vice versa, and well element transfer devices 57 and 58 (FIGS. 6 and 7) to transfer, respectively, the pipes 21 and the rods 35 (FIG. 3) from storage racks 54 and 55 (FIGS. 6 and 7) to the manipulator 56 and vice versa.

Thus, the pipe racking stand 2 is a separate assembly unit which is separated from the well pipe handling device, which makes it easier to mount it in the well as well as to provide better conditions for its adjustment, maintenance, and transportation.

Figure 6B:
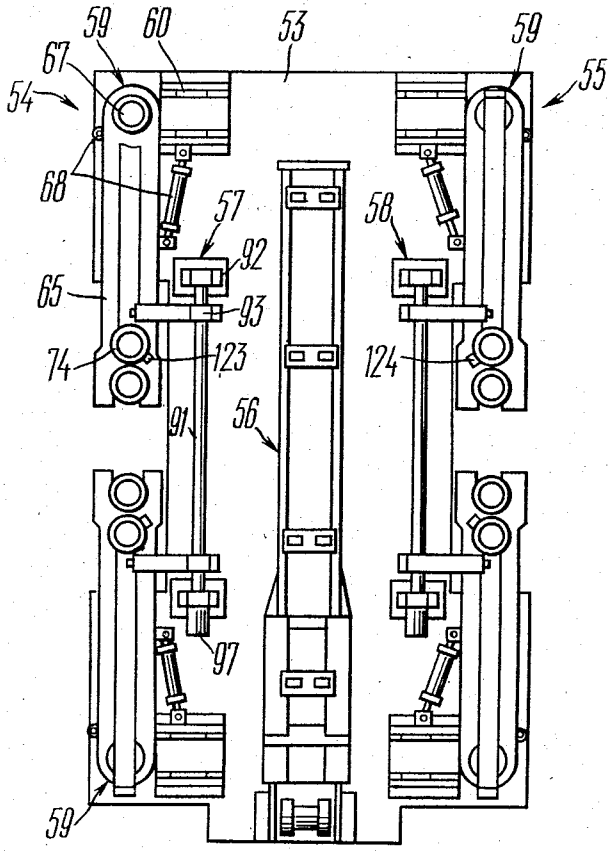
FIG. 6*b* is a view of the same rack in a transport position.

The storage rack 54 for storing the pipes 21 in a horizontal position comprises at least two support bars 59 having an L-shaped configuration and mounted on the second base 53 for rotation about horizontal pilot pins 60. The support bars 59 are kinematically connected with a means 61 for rotation and locking the same bars (FIG. 7). A modification of the means 61 shown in FIGS. 6 and 7 consists of two jacks 62, each of said jacks being vertically mounted on its own foot 63 adjacent the base 53 and connected with the end of a corresponding support bar 50 by means of a horizontal pivot pin 64 (FIG. 7).

Each support bar 59 is made of several components and comprises a support beam 65 and a pivot shackle 66 connected with the support beam 65 by means of a vertical pivot pin 67 enabling the support beam 65 to rotate in a horizontal plane so as to be set in a transport position. The support beam 65 is thus disposed along the lateral sides of the base 53 and occupies a minimum of space (FIG. 6*b*). For such a rotary motion the storage rack 54 is provided with a drive 68 for rotating the support beams and locking them in an operating position and in a transport position, the drive 68 including hydraulic cylinders and catches.

Figure 7A:
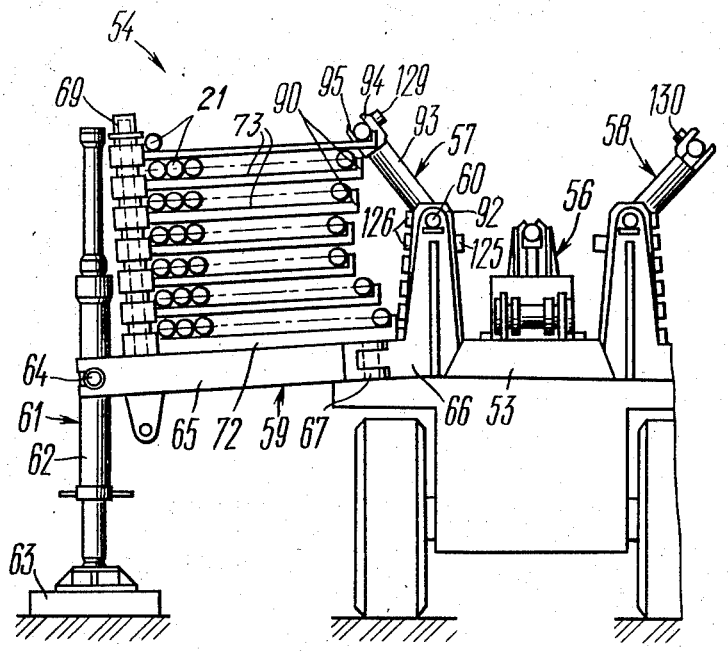
FIGS. 7*a* and *b* are views along the arrow C in FIG. 6*a*, in FIG. 7*a* the rack being shown in the loading position, while in FIG. 7*b* the same rack being shown in the unloading position.
Figure 7B:
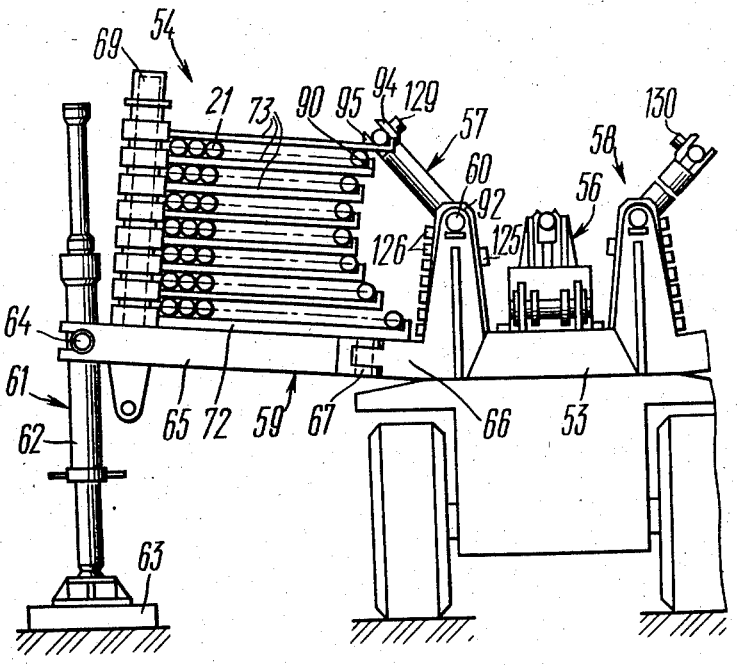
Figure 8:
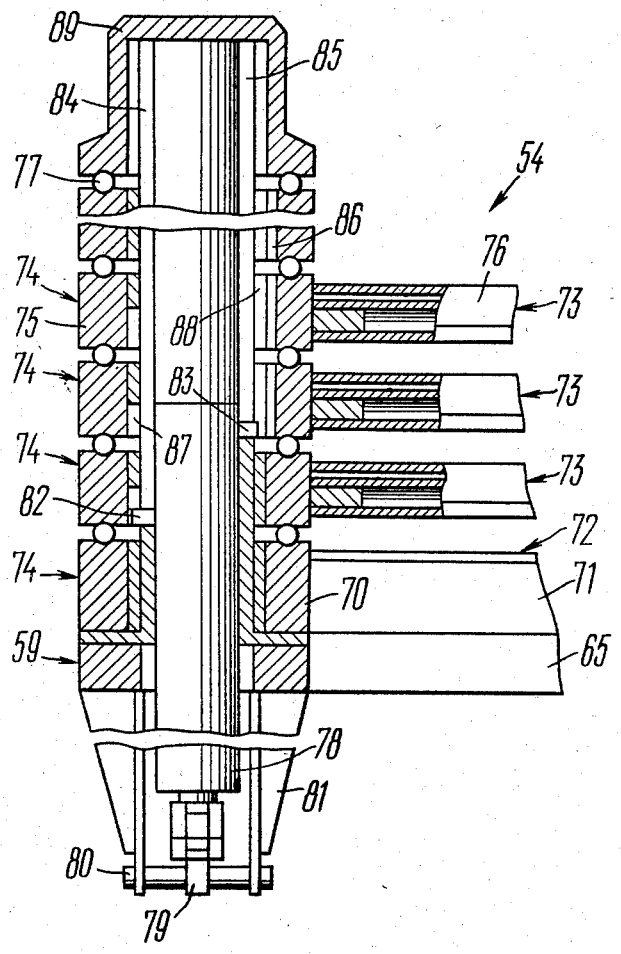
FIG. 8 is an enlarged sectional view along the line VIII—VIII in FIG. 6*a;*

The support beam 65 of each support bar 59 (FIG. 7) has a hollow column 69 which is rigidly secured thereto (FIG.8). On each column 69 there is a bush 70 rigidly secured thereon and disposed so that its foot is adjacent the support beam 65. Disposed adjacent the periphery of the bush 70 there is a strip 71 rigidly secured on the support beam 65. The bush 70 and the strips 71 of both support bars 59 (FIG. 6) form a stationary lower shelf 72 (FIGS. 7, 8) of the storage rack 54. Each of the shelves 73 disposed above lower shelf 72 (FIG. 8) comprises two supports 74, each of the supports 74 includes a bush 75 consisting of several components, and a strip 76 joined with the outer surface of the bush 75 and rigidly connected with the latter.

To decrease the friction during rotation of the supports 74, there are provided rolling members 77 between their bushes 75. For the rolling members each bush 70 and 75 has corresponding recesses in a casing.

To rotate the supports 74, there is provided a drive for moving the shelves 73 between an operating position and a non-operating position, which drive includes hydraulic cylinders 78 which are hydraulically interconnected and mounted within the hollow column 69. A piston rod 79 of each hydraulic cylinder 78 is connected by a pivot pin 80 with a post 81 rigidly connected on the lower surface of the support beam 65 of the support bar 59.

The sleeve of the hydraulic cylinder 78 is provided with two cylindrical pins 82 and 83 disposed radially on different sides of its lateral surface.

The pin 82 is secured to the sleeve of the hydraulic cylinder 78 so that in its extreme position with respect to the piston rod 79 it is disposed on the level of the lower edge of the bush 75 of the first shelf of the movable shelves 73, and the pin 83 is displaced upwards by the height of one shelf equal to the height of the bush 75.

The column 69 is provided with slots 84 and 85 of different length for said pins to pass therethrough. The pins 82 and 83, throughout the length thereof extend beyond the outer lateral surface of the column 69.

Within each bush 75 there is provided a sleeve 86 having two slots 87 and 88. The slot 87 is made in a helical manner and constitutes 0.25 of a turn on the height where the bush 75 is disposed, which makes it possible to rotate the support 74 through 90° in accordance with the operation of a bayonet lock when displacing the pin 82 by the sleeve of the hydraulic cylinder 78 for the length of a stroke equal to the thickness of one shelf 73. The slot 88 is straight and makes it possible to prevent the above disposed shelf 73 from rotation (when the sleeve of the hydraulic cylinder 78 is being displaced) by the pin 83 advancing in the slot 85 of the column 69.

The above-described construction of the shelves and the drive for putting them into operation makes it possible to displace not the whole shelf but each support separately. Such displacement can be carried out in opposite directions. This allows the compactness of the storage rack 54 to be improved, which results in a lower specific quantity of metal per pipe racking stand 2 as a whole. However, it will be understood that the shelves and said drive can be constructed in another manner, for instance, the strips 76 of the shelf 73 can be interconnected by means of a pivoted rod. In this case the supports 74 can be rotated only in one direction, and to withdraw the shelf and put it into operation, one hydraulic cylinder 78 or another rotation drive is sufficient.

The upper end of each column 69 is provided with a cap 89.

To prevent the pipes from rolling down from the shelves 72 and 73 of the storage rack 54, the free ends of the strips 71 and 76 are provided with rigid rests 90 (FIG. 7).

The storage rack 55 (FIG. 6) for storing the rods 35 (FIG. 3) is similar to the storage rack 54 (FIGS. 6 to 8) and differs therefrom only in size.

The pipe transfer device 57 for transferring pipes from the storage tank 54 into the manipulator 56 and in the opposite direction comprises a horizontally disposed shaft 91 (FIG. 6) mounted for rotation into stands 92 mounted on the second base 53 between the storage rack 54 and the manipulator 56. On the shaft 91, near the stands 92, there are rigidly secured two booms 93 carrying grippers 94 and 95 (FIG. 9) and a drive 96 for closing and opening said grippers. The shaft 91 is kinematically connected with a drive 97 for turning the booms 93 (FIG. 6), said drive 97 being mounted on one of the stands 92.

Each boom 93 is telescopic (FIG. 9) and consists of two portions: a holder 98 mounted on the shaft 91 and a front portion which is a housing 99 mounted movably in the holder 98 and kinematically connected with a drive 100 for effecting linear displacement for drawing the housing 99 into the holder 98 and for drawing the housing 99 therefrom, the drive 100 being mounted in the holder 98.

The drive 96 for closing the grippers 94 and 95 comprises a hydraulic cylinder 101 and a coupling device consisting of a master cam 102 mounted on the gripper 94 and a roller follower 103 connected with the rod of the hydraulic cylinder 101. The gripper 94 is provided with a slide 104 mounted in the housing 99 for transverse displacement, for which purpose the housing 99 is provided with transfer guideways 105. The gripper 95 is mounted in the same housing for longitudinal movement and is loaded with a spring 106. The housing 99 is provided with longitudinal guideways 107 for the gripper 95. It will be clear from the description of the invention that such a construction of the boom 93 makes it possible to grip the pipe 21 from the shelf 72 or 73 of the storage rack 54 (FIG. 7) under difficult conditions in view of lack of space because of tight (without gaps) installation of the pipes 21. Apart from a decrease in sizes of the storage rack and the pipe racking stand and, correspondingly, in a lower specific quantity of metal per structure, such installation of pipes allows the described storage rack to be used without readjustment for pipes of different diameters.

In a preferred embodiment of the apparatus the horizontal pivot pins 60 of the storage rack 54 and the horizontally disposed shaft 91 of the pipe transfer device 57 are coaxial (FIGS. 6,7). Such being the case, the rests 90 (FIG. 7) on the shelves 72 and 73 of the storage rack 54 (in an operating position of these shelves) are disposed so that when projected to a surface perpendicular to the common geometrical axis of the shaft 91 and the pivot pins 60, they form a circle with the center thereof disposed on this axis.

The rod transfer device 58 for transferring the rods 35 is structurally similar to the pipe transfer device 57 and differs therefrom only in sizes.

The manipulator 56 is a boom mounted on the second base 53 for rotation about a horizontal pivot pin 108 with the aid of a drive 109 for moving said manipulator 56. The drive 109 is a hydraulic cylinder pivotally connected with the base 53 and having a rod pivotally connected with the manipulator 56.

Mounted on the manipulator 56 for longitudinal movement is a slide 110 carrying two pairs of grippers 111 and kinematically connected with a drive 112 for longitudinally moving these grippers. Each pair of the grippers 111 is provided with a drive 113 enabling said grippers to close and open and is mounted on the slide 110. The manipulator 56 has already been described in more detail in our patent application mentioned before "Automated apparatus for handling elongated well elements".

It will be understood that the presence of two storage racks and the two well element transfer devices in the racking stand of the apparatus is not obligatory and is for convenience only. It is also evident that instead of two booms the well element transfer device may comprise only one boom of a considerable width, and when the pipes or rods are of a considerable length, the number of booms may be increased. The boom as a movable element in the transfer device is not obligatory at all (though preferable). This boom can be replaced by a carriage mounted for translational movement in a horizontal plane and in a vertical plane.

It is also to be noted that all the above drives of the apparatus (both described in detail and only enumerated and designated by reference numerals) are hydraulic and included in a general hydraulic system not shown in the drawings for simplicity reasons.

The automated apparatus according to the invention comprises an automatic control system including a system of electrically controlled actuating mechanisms acting upon all said drives and being valve spools (solenoid-operated hydraulic valves) controlling the operation of hydraulic cylinders and hydraulic motors, a system of control units electrically connected with these solenoid-operated hydraulic valves, sensors and a control console, electrically connected with the control units, which will be described hereinbelow.

For simplicity, the solenoid-operated valves of the system of electrically controlled actuating mechanisms are not shown. In addition, to avoid lengthy repetitions in the further description of the control system, in all cases when the electrical connection between the control units with drives of the operators (or delivery of control signals to these drives) are discussed, the actuating mechanisms through which this connection is realized (or the signals are delivered) will not be mentioned.

Generally, the system of control units includes: a control unit 114 for controlling lowering and raising operations (FIG. 10), a control unit 115 for controlling the automatic tong 7, a control unit 116 for controlling the manipulator 56, and a control unit 117 for controlling loading and unloading operations.

The control unit 114 for controlling the lowering and raising operations is intended to control the operation of the elevator 9 (FIG. 1) and the spider 11 and serves to deliver control signals to the drive 12 for vertically moving the upper means for suspending the string 8, the drive 43 for closing and opening the grippers 42 of the elevator 9, and the drive 52 for closing and opening the grippers 50 of the spider 11.

The control unit 115 for controlling the automatic tong 7 (FIG. 10) is intended to also control the operation of the components of the tong in the case where it is the automatic pipe tong 7'. The control unit 115 delivers control signals to the drive 13 for transversely displacing the automatic tong (FIG. 2), drives 19, 24, and 29 for closing and opening the grippers, respectively, 18, 23, and 27, and the rotation drives 20 and 25. If rods are manipulated during lowering and raising operations instead of pipes, the control unit 115 (FIG. 10) is connected to the automatic rod tong 7'' (FIG. 3) and delivers control signals to the drive 13 for transversely displacing the tong, the drive 41 for closing and opening the grippers of the locking device 33 (FIGS. 3 and 5), and the rotation drive 36 (FIG. 3).

The control unit 116 for controlling the manipulator 56 (FIG. 10) delivers control signals to the drive 113 for closing and opening the grippers 111 of the manipulator 56 (FIG. 1), to the drive 112 for longitudinally moving said grippers; and to the drive 109 for moving the manipulator 56.

The control unit 117 for controlling loading and unloading operations (FIG. 10) is intended to control the operation of the components of the pipe transfer device 57 and the rod transfer device 58 (FIGS. 6 and 7) and the storage racks 54 and 55 for pipes and rods respectively. The control unit 117 delivers control signals to the drive 96 for closing and opening the grippers 94 and 95 of the pipe transfer device 57 and the rod transfer device 58 (FIG. 9), to the drives 97 for turning the booms 93 of these devices, to the drives 100 for effecting linear displacement, and to the hydraulic cylinders 78 of the drives and withdrawing the shelves 73 of the storage racks 54 and 55 (in FIG. 10 the connections between the control units and said drives are indicated by reference numerals of these drives).

Figure 10:
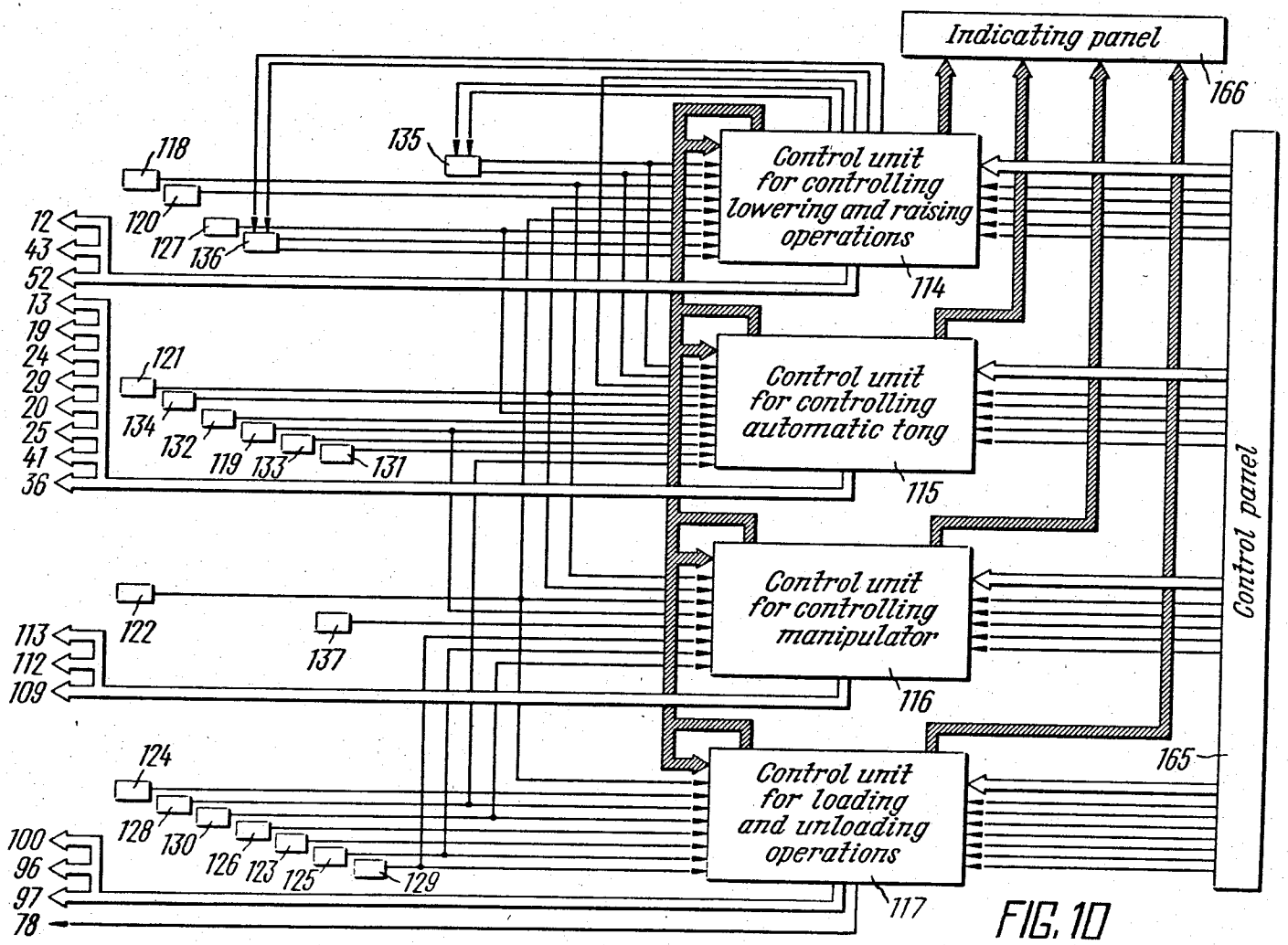
FIG. 10 is a block diagram of the control system in the apparatus of the invention.

The control system of the apparatus of the present invention comprises the following sensors (FIG. 10);

sensors 118, 119, and 120 of, respectively, the upper position, intermediate position, and lower position of the elevator 9 (position sensors of the upper means for suspending the string 8);

position sensor 121 of the automatic tong 7;

position sensor 122 of the manipulator 56;

position sensors 123 and 124 of the shelves of the storage racks, respectively, 54 and 55;

position sensors 125 and 126 of the booms 93 of, respectively, the pipe transfer device 57 and the rod transfer device 58;

position sensor 127 of the grippers of the elevator 9 and of the spider 11;

position sensors 128 of the grippers 111 of the manipulator 56;

position sensors 129 and 130 of the grippers 97 and 98 of the pipe transfer device 57 and the rod transfer device 58;

sensors of the automatic tong or, more specifically, of corresponding components of this tong, including:

torque sensor 131 of the high-torque device 14 of the automatic pipe tong 7';

angle data transmitter 132 of the high-torque device 14 of the automatic pipe tong 7';

torque sensor 133 of the low-torque device 15 of the automatic pipe tong 7';

torque sensor 134 of the swivel-head 32 of the automatic rod tong 7''.

In addition, the control system of the apparatus of the present invention comprises a first position sensor 135, a second position sensor 136, and a third position sensor 137 of the pipe 21 or the rod 35.

The position sensors 118, 119 and 120 are disposed in the way of displacement of the elevator 9 (FIG. 1) and are mounted on the derrick 6 and are intended to deliver signals about the disposition of the elevator 9 in, respectively, an upper position, an intermediate position, and a lower position.

The position sensor 118 is electrically connected through the control units 114 and 116 with the drive 12 for vertically moving the upper means, and with the drive 109 for moving the manipulator 56.

The position sensor 119 is electrically connected through the control units 115 and 116 with the drive 13 for transversely displacing the automatic tong (FIG. 1) and with the drive 109 for moving the manipulator 56.

The position sensor 120 is electrically connected through the control unit 114 (FIG. 10) with the drive 52 (FIG. 1) for closing and opening the grippers 50 of the spider 11.

The position sensor 121 of the automatic tong 7 (FIGS. 2 and 3) is mounted on the casing 30 (30') and is intended to deliver one of the two signals "approached" or "withdrawn". The first signal corresponds to an operating position of the tong 7 (when the openings formed by the grippers thereof when being closed are disposed along the axis of the well). The second signal corresponds to non-operating position of the tong 7.

The position sensor 121 is electrically connected through the control units 114, 115, and 116 (FIG. 10) with the drive 43 of the grippers 42 of the elevator 9 (FIG. 1), with the drive 12 for vertically moving the elevator 9, with the drive 13 for transversely displacing the automatic tong 7, with the drive 109 for moving the manipulator 56, and with the drive 112 for longitudinally moving the grippers 111 of the manipulator 56.

The position sensor 122 of the manipulator 56 is mounted on the manipulator 56 on the side opposite to the well and is intended to deliver one of the two signals "approached" or "withdrawn". The first signal corresponds to an operating (vertical) position of the manipulator 56, and the other signal corresponds to a non-operating (horizontal) position of the manipulator 56.

The position sensor 122 is electrically connected through the control units 116, 114, and 117 (FIG. 10) with the drive 109 for moving the manipulator 56 (FIG. 1), with the drive 12 for vertically moving the elevator 9, with the drive 52 for closing and opening the grippers 50 of the spider 11, and with the drive 97 for turning the booms 93 of the pipe transfer device 57 and the rod transfer device 58.

The position sensors 123 and 124 of the shelves 73 of the storage racks, respectively, 54 and 55 (FIG. 6) are intended to deliver one of the two signals "approached" or "withdrawn", the first of which corresponds to an operating position of the shelf, and the other one corresponds to its non-operating position (when the support beams 65 are turned to each other and extend along the base 53). The position sensors 123 and 124 are disposed on the supports 74 of the shelves 73 of the storage racks, respectively 54 and 55.

The position sensors 123 and 124 are electrically connected through the control unit 117 (FIG. 10) with the hydraulic cylinders 78 of the drive for forwarding the shelves 73 of the storage racks 54 and 55.

The position sensors 125 and 126 of the booms 93 of the pipe transfer device 57 and the rod transfer device 58 are disposed on stands 92 (FIG. 7) of these devices in accordance with the angle of rotation of these booms between the manipulator 56 and a corresponding shelf 72 or 73 of the storage racks 54 and 55. The position sensor 125 is intended to deliver a signal "approached" corresponding to the position of the boom 93 in which its grippers 94 and 95 enter the space between the grippers 111 of the manipulator 56 to transfer thereto or therefrom the pipe 21 or the rod 35 by the pipe transfer device 57 or the rod transfer device 58. The position sensor 126 is intended to produce a signal "withdrawn" corresponding to the position of the booms 93 in which position it is possible to transfer the pipe 21 or the rod 35 from the pipe transfer device 57 or the rod transfer device 58 to the respective shelf 72 or 73 of the storage rack 54 or 55 and in a reversed direction.

The position sensor 125 is electrically connected through the control units 117 and 116 (FIG. 10) with the drive 97 for turning the booms 93 (FIG. 6) of the pipe transfer device 57 and the rod transfer device 58, with the drive 100 for effecting linear displacement, and with the drive 113 for closing and opening the grippers 111 of the manipulator 56.

The position sensor 126 is electrically connected through the control unit 116 with the drives 96, 97, and 100.

The position sensor 127 of the grippers of the elevator-spider is intended to deliver one of the two signals "open" or "closed". The first of said signals corresponds to the position in which the grippers 42 of the elevator 9 are open (FIG. 1) and the grippers 50 of the spider 11 are closed. The second signal corresponds to the position in which the grippers 42 of the elevator 9 are closed, and the grippers 50 of the spider are open.

Figure 11:
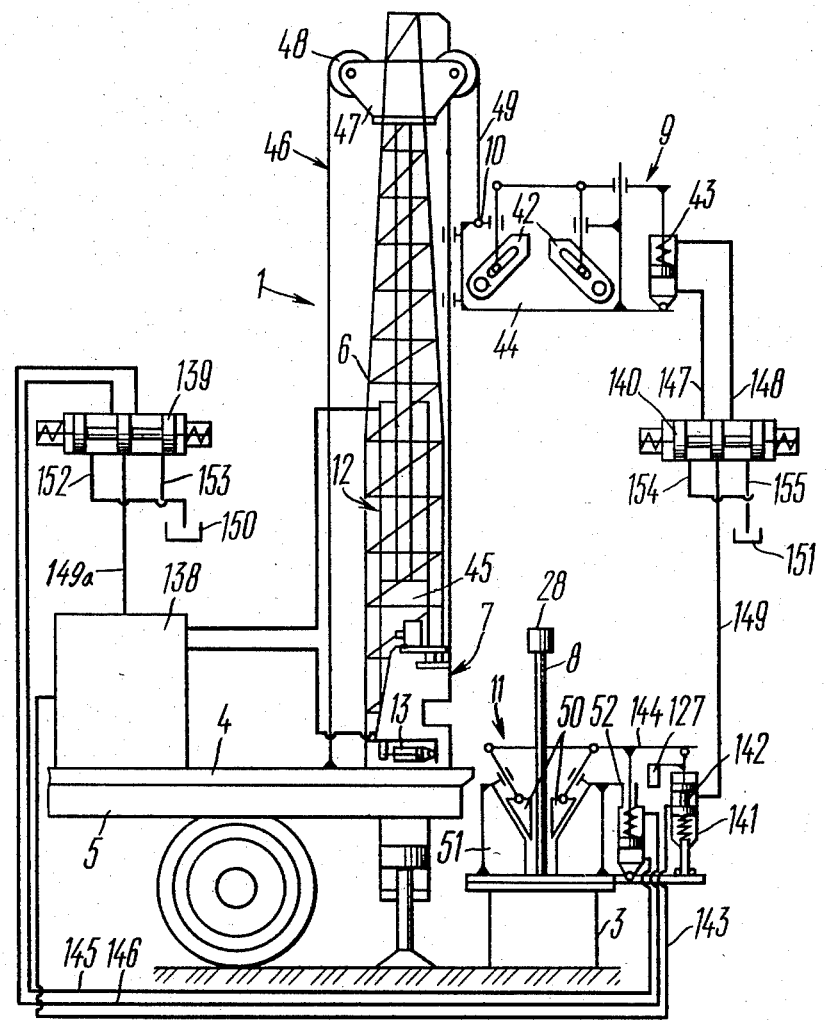
FIG. 11 is a portion of the hydraulic circuit of the apparatus according to the invention.

To perform said function, the position sensor 127 is mounted in a device for locking the grippers of the elevator 9 and the spider 11 shown in FIG. 11.

Shown in FIG. 11 is a fragmentary view of a hydraulic system of the apparatus of the present invention comprising a pumping unit 138 which is a source of hydraulic power and which is intended to deliver a hydraulic liquid to the drives of the components of the apparatus and which is mounted on the first base 4, two valve spools 139 and 140, the first of which controls the operation of the hydraulic cylinder which is the drive 52 for closing and opening the grippers 50 of the spider 11, while the second of which controls the operation of the hydraulic cylinders which is a drive 43 for closing and opening the grippers 42 of the elevator 9. The device for locking the grippers of the elevator 9 and the spider 11 comprises a check valve 141 with a spool 142, which check valve 141 is normally closed and mounted on a delivery line 143 communicating the pumping unit 138 with the valve spool 140, and a rest 144 rigidly connected with the rod of the hydraulic cylinder 52 and interacting with the spool 142 of the hydraulic check valve 141. Reference numerals 145 and 146 designate the pipelines connecting the inner spaces of the hydraulic cylinder 52 with the valve spool 139. Reference numerals 147 and 148 designate pipelines connecting the inner spaces of the hydraulic cylinders 43 with the valve spool 140, a reference numeral 149*a* designates a delivery pipeline between the pumping unit 138 and the valve spool 139, and reference number 149 designates a delivery pipeline between valve spool 140 and valve spool 142. The hydraulic system incorporates overflow tanks 150 and 151. The tank 150 communicates with drain pipelines 152 and 153, connected with the valve spool 139, and the tank 151 communicates with drain pipelines 154 and 155 of the valve spool 140.

The position sensor 127 is rigidly connected with the spool 142 of the hydraulic check valve 141, due to which the signal produced by said sensor 127 is indicative of the position of the grippers of the elevator 9 and the spider 11.

The above described arrangement of the device for locking the grippers of the elevator 9 and the spider 11 is a preferable one from the point of view of reliability and safety of the operation of the apparatus, but not the only one possible. This same function can be accomplished in any other way, such as by using instead of one sensor 127 four controllers (not shown) in the control system of the apparatus to produce four signals: a signal for opening the elevator 9, a signal for closing the elevator 9, a signal for opening the spider 11, and a signal for closing the spider 11. To prevent the elevator 9 and the spider 11 from being opened simultaneously, the elevator opening controller and the spider closing controller should be connected in an AND gate fashion, as well as the elevator closing controller and the spider opening controller.

The position sensor 127 is electrically connected through the control units 114 and 115 (FIG. 10) with the drive 12 for vertically moving the upper means and with the drive 29 for closing and opening the grippers 27 of the locking device 16 (or with the drive 41 for closing and opening the grippers 40 of the locking device 33).

The position sensors 128 of the grippers 111 of the manipulator 56 (FIG. 1) and position sensors 129 and 130 of the grippers 94 and 95 of the pipe transfer device 57 and the rod transfer device 58 (FIG. 7) are mounted on corresponding grippers and are intended to produce one of the two signals "open" or "closed". The first of the signals corresponds to the position in which the grippers are opened and the second one corresponds to the position in which they are closed.

The position sensors 128 are electrically connected through the control units 117, 115 (FIG. 10) with the rotation drive 25 for rotation the low-torque device 15 (FIG. 2) or with the rotation drive 36 of the swivel-head 32 (FIG. 3), with the drive 96 for closing and opening the grippers 94 and 95 (FIG. 9) of the pipe transfer device 57 and the rod transfer device 58, with the drive 97 for turning the booms 93 of these devices, and with the drive 100 for enabling linear displacement.

The position sensors 129 and 130 are electrically connected through the control units 117 and 116 (FIG. 10) with the drives 97 for turning the booms of the pipe transfer device 57 and the rod transfer device 58 (FIG. 6), with the drive 112 for longitudinally moving the grippers 111 of the manipulator 56 (FIG. 1), and with the drive 113 for closing and opening these same grippers.

The angle-data transmitter 132 (FIG. 2) is mounted on the first clamping means 17 of the tong 7' and is intended to produce a signal which corresponds to a preset rotation angle which is provided by the rotation drive 20 (corresponding to the angle of tightening the screw). The angle-data transmitter 132 is electrically connected through the control unit 115 (FIG. 10) with the drive 19 for closing and opening the grippers 18 of the high-torque device 14 (FIG. 2), with the drive 29 for closing and opening the grippers 27 of the locking device 16, and with the rotation drive 20 for rotating the high torque device 14.

All the above sensors 118 to 130 and the angle-data transmitter 132 (FIG. 10) are conventional contactless position sensors and a conventional contactless angle-data transmitter, respectively, which operate when a metal plate (operation indicator) not shown in the drawings is introduced into the zone of their action. For the sensors indicating one position there is used one operation indicator, for the sensors indicating two positions, two operation indicators.

The torque sensors 131, 133, and 134 in a preferred embodiment of the invention are pressure controlling devices such as a pressure relay or electric contact pressure gauges. These sensors are mounted on respective components of the automatic tong 7' (FIG. 2) or 7'' (FIG. 3) and are intended to produce a signal corresponding to a preset maximum or minimum torque developed by this device while screwing or unscrewing a screw joint, which signal determines the end of the operation.

The torque sensor 131 of the high-torque device 14 is electrically connected through the control unit 115 (FIG. 10) with the drive 19 for closing and opening the grippers 18 of the high-torque device 14 (FIG. 2), with the rotation drive 20, and with the drive 29 for closing and opening the grippers 27 of the locking device 16.

The torque sensor 133 of the low-torque device 15 is electrically connected through the control unit 115 (FIG. 10) with the rotation drive 25 (FIG. 2).

The torque sensor 134 of the swivel head 32 (FIG. 3) is electrically connected through the control unit 115 (FIG. 10) with the rotation drive 36 (FIG. 3).

The first and the second position sensors 135 and 136 of a pipe or a rod are inductive differential sensors of a suitable design.

Figure 12:
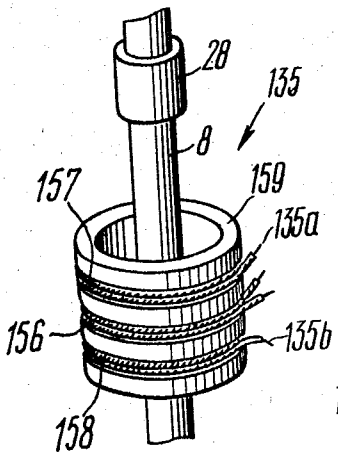
FIG. 12 is a diagrammatical representation of a first well element position sensor in the apparatus of the invention.

FIG. 12 of the drawings shows the first sensor 135 having one excitation winding 156 and two output windings 157 and 158, connected anti-in-series. The winding 156 is disposed in the middle annular groove of a cylindrical core 159, and the windings 157 and 158 are disposed in the extreme grooves of the same core. The sensor 135 is disposed on the carriage 10 (FIG. 1) of the upper means for suspending the string 8. The sensor 135 produces a signal when the butt-end of the threaded sleeve 28 appears in the zone of its action. Through the control units 114 and 115 (FIG. 10) this sensor is electrically connected with the drive 12 for vertical displacement (FIG. 1), with the drive 43 for closing and opening the grippers 42 of the elevator 9, with the drive 13 for transversely displacing the automatic tong 7, and with the drive 29 for closing and opening the grippers 27 of the locking device 16 (FIG. 2) or the drive 41 for closing and opening the grippers 40 of the locking device 33 (FIG. 3).

Figure 13:
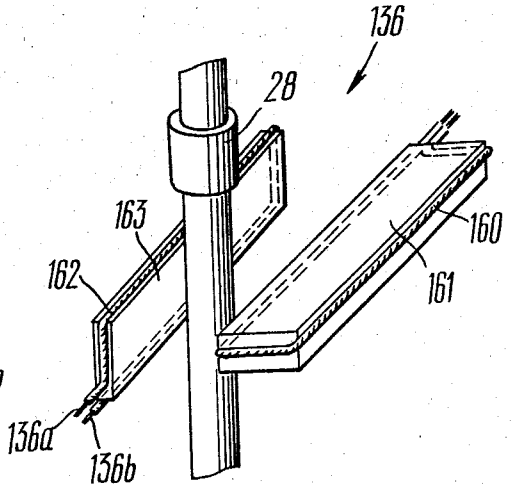
FIG. 13 is a diagrammatical representation of a second well element position sensor in the apparatus of the invention.

FIG. 13 of the drawing shows a second sensor 136 whose operation does not differ from the operation of the sensor 135, and whose constructional peculiarities are conditioned by the necessity of moving the tong 7, on which it is mounted, (FIG. 1) from aside upon the string 8 secured in the spider 11 and upon the pipe 21 (or the rod 35) mounted along the axis of the well in grippers 111 of the manipulator 56. The sensor 136 has an excitation winding 160 (FIG. 13) secured to a horizontal plate 161 and an output winding 162 secured to a vertical plate 163. The plates 161 and 163 are secured on the locking device 16 (FIG. 2) or 33 (FIG. 3) of the tong, respectively, 7' or 7'' and define an opening for a string of pipes or rods.

The sensor 136 is intended to produce a signal when in the zone of its action there appears the threaded sleeve 28 (FIG. 13) which sleeve is a component of the string 8. Through the control unit 114 (FIG. 10) this sensor is electrically connected with the drive 12 for vertically moving the upper means.

The sensor 137 is made in the form of a limit switch. A modification is possible according to which this sensor is structurally similar to the sensor 135 (FIG. 12) which is more simple than the sensor 136. Besides, this sensor can be made in the form of any conventional position sensor similar to the above described above sensors 118 to 130 or angle-data transmitter 132 (FIG. 10) and interacting directly with the butt-end of the pipe 21 or the rod 35 (FIG. 1) clamped in the grippers 111 of the manipulator 56 on which it is mounted between the slide 110 and the horizontal pivor pin 108. Through the control unit 116 (FIG. 10) this sensor is electrically connected with the drive 112 for longitudinally moving the grippers 111 of the manipulator 56 (FIG. 1) and with the drive 109 for moving said manipulator.

Thus, as it will be clear from the further description of the operation of the apparatus, the sensors 135 and 136 substantially regulate the position and the length of displacement of the elevator 9 bringing this position and the length of displacement of the elevator 9 into correspondence with the length of the pipe 21 (or rod 35) being connected to the string or disconnected therefrom. The sensor 137 provides for the consistency of the initial position while screwing the pipe 21 (or the rod 35) delivered by the manipulator 56, independently of the length of the pipe (or the rod).

The control units 114 to 117 (FIG. 10) are electrically connected with the control console 164 (FIG. 14) having a control panel 165 (FIGS. 10 and 14) with switch arms, switches, control buttons, and an indicating panel 166 with signal lamps intended to signal the realization of the operations carried out by the apparatus.

It is to be noted that here and hereinbelow the outputs of the units and other components of the control system as well as the units and components of the same system are designated by like lettering in the form of small Latin letters. The inputs of these units and components (except some of them) have no designations. Instead, in parentheses there are designations of those outputs with which respective inputs are connected.

If necessary, the inputs and respective units or some other components are designated by capital Latin letters.

On the control panel 165 (FIG. 14) there are disposed the following main controls:

a "Start" button 167 corresponding to the output 165*a;* a "Stop" button 168 corresponding to the output 165*b;*

"Counter setting" button 169 corresponding to an output 165*c;*

"Auto-manual" switch arm 170 corresponding to an output 165*d;*

"Lowering-raising" switch arm 171 corresponding to an output 165*e;*

"Counter setting" switch 172 corresponding to an output 165*f;*

"Number of pipes or rods setting" switch 173 corresponding to an output 165*g;*

"Number of shelves setting" switch 174 corresponding to an output 165*h.*

The purpose of each of said controls will be clear from the description of the operation of the apparatus given hereinbelow.

In a preferred modification of the control system of the apparatus of the present invention the connection between the units 114 to 117 (FIG. 10) and the control console 164 as well as with the sensors 118 to 137 is realized through an assembly of opto-isolators (not shown) providing for a galvanic isolation between sparking and non-sparking circuits. The control console 164 and the sensors 118 to 137 of the control system of the apparatus are connected to a non-sparking power unit. This makes it possible to use conventional control equipment both on the control console 164 and in the components of the apparatus, when disposed in a dangerously explosive zone.

A programmed logical control unit 175 (FIG. 15) is a structural base for each of said control units 114 to 117 of the control system of the apparatus of the present invention.

Unit 175 comprises:

an instruction coding means 177 for specifying the sequence of the codes of instructions sent to corresponding blocks in accordance with a pre-assigned process cycle;

a displacement program block 176 for specifying a first program for bringing the actuators into operation in accordance with the codes of instructions coming thereto, and producing a signal for switching on the power amplifiers of the actuators;

a timer 178 producing a signal at the moment of termination of the time which is determined by the instruction code specified by the instruction coding means;

a wait program block 179 for specifying a second program, which determines the codes of instructions resulting in operation of corresponding sensors, followed by reswitching the instruction coding means;

a clock program block 180 for specifying a third program, which determines the codes of instructions that end on the expiration of the preset time, following by reswitching the instruction coding means;

a sensor program block 182 for specifying the second program, which determines the codes of instructions resulting in operation of corresponding sensors, and a fourth program, which determines the codes of instructions resulting in operation of corresponding sensors with control of the time of execution of the current instruction, followed by reswitching the instruction coding means;

a commutator 181 for switching signals for selective switching-on of the timer 178, the wait program block 179, and the clock program block 180;

clock driver 183 presetting the duration of carrying out the instruction produced by the programmed logical control unit 175;

trigger shaper 184 of start signals, serving to switch on and off the programmed logical control unit 175;

display unit 185 responding to the output signals of the counter 177 and producing signals indicative of the realization of an instruction to the indicating panel 166 (FIG. 10) of the control console 164;

crystal oscillator 186 (FIG. 15) comprising a frequency divider and producing pulses of different frequencies necessary for operating the components of the programmed logical control unit 175;

power amplifier 187 serving to switch on and off electrohydraulic valves acting upon the drives of corresponding components of the apparatus.

Such being the case, the inputs of the programmed logical control unit 175 are:

inputs 182A of a sensor program block 182, connected with those of the above-described sensors which, as described above, should be electrically connected with a control block including said programmed logical control unit 175;

inputs of the trigger shaper 184, connected to the inputs 165*a* and 165*b* of the control panel 165;

input of the clock driver 183, connected to the input 165*d* of the control panel 165;

inputs of the counter 177 connected to the outputs 165*e*, 165*f*, and 165*c* of the control panel 165;

inputs of the blocks 176, 179, 180, 182, and the timer 178, connected to the input 165*e* of the control panel 165;

inputs 184A of the trigger shaper 184 and inputs 178A of the timer 178, connected to the outputs of other components included into the control unit of which said programmed logical control unit 175 is a part.

The outputs of the apparatus 175 are inputs 187*a* of the power amplifiers 187 connected with electrohydraulic valves of corresponding drives and inputs 185*a* of the display unit 185, connected with the inputs of the indication panel 166.

In addition, the apparatus 175 may comprise a number of inputs and outputs, intended for connection with the components incorporated in other control units.

Within the programmed logical control unit 175 the above components are connected in the following way.

The inputs of the power amplifiers 187 are connected to the outputs 176*a* of the displacement program block 176 whose inputs, in their turn, are connected to the outputs 177*a* of the counter 177 and with the outputs 184*a* and 184*b* of the trigger shaper 184.

The inputs of the counter 177, apart from the above-mentioned inputs connected with the control panel 165, are connected with the output 183*a* of the clock driver 183. The inputs of the timer 178, of the wait program block 179, of the clock program block 180, and of the sensor program block 182 are connected to the outputs 177*a* of the counter 177. The timer 178 and the sensor program block 182 are connected to the outputs 184*a* and 184*b* of the trigger shaper 184, and the outputs 178*a*, 179*a*, 180*a* of, respectively, the timer 178, the wait program block 179, and the clock program block 180 are connected with the inputs of the commutator 181 having the output 181*a* connected with one of the inputs of the trigger shaper 184 and the output 181*b* connected with one of the inputs of the sensor program block 182. The clock driver 183 through one of its inputs is connected with the output 182*a* of the sensor program block 182, and through one of its outputs 183*b* is connected with the input of the trigger shaper 184. The inputs of the display unit 185 are connected with the outputs 177*a* of the counter 177 and the output 184*c* of the trigger shaper 184. The outputs 186*a*, 186*b*, and 186*c* of the crystal oscillator 186 are connected to the inputs of, respectively, the clock driver 183, the timer 178, and the display unit 185. Besides, the input 178A of the timer 178 is connected with the inputs of the counter 177 and the inputs of the blocks 176, 179, 180, and 182.

The above mentioned displacement program block 176, timer 178, wait program block 179, clock program block 180, sensor program block 182, and display unit 185 are either widely known devices such as the timer, or are such devices the realization of which in accordance with said function is possible on the basis of logical matrices and which are well known to those skilled in the art.

Instruction coding means 177 can be realized in the form of a processor or a counter. In order to simplify the description and explanation of the essence of this invention, the simplest embodiment of instruction coding means 177 in the form of a counter will be considered henceforth. Therefore, the term "counter 177" will be used henceforth in the specification instead of the term "instruction coding means."

The power amplifier unit 187 includes conventional power amplifiers, such as a Darlington amplifier.

The counter 177 includes a conventional bidirectional counter 188 (FIG. 16) intended to produce instructions while carrying out two technological cycles of operation of the apparatus (while raising the pipes or rods—counting up, and while lowering the pipes or rods—counting down), a device 189 for an initial setting of the bidirectional counter 188, said device 189 being described hereinbelow, a memory 190, and a decoder 191 for decoding the code of a bidirectional counter 188. The inputs of the bidirectional counter 188 are the inputs of the counter 177 connected to the input 178A of the timer 178, as well as the inputs of the counter 177 connected to the output 165*e* of the control panel 165 and to the output 183*a* of the clock driver 183. The inputs of the device 189 for an initial setting of the bidirectional counter 188 are the inputs of the counter 177 connected to the outputs 165*c* and 165*f* of the control panel 165. The outputs of the decoder 191 are the outputs 177*a* of the counter 177. The decoder 191 is connected by its inputs to the outputs 188*a* of the bidirectional counter 188 whose inputs are connected to the outputs of the device 189.

The memory 190 through its inputs is connected with the outputs 188*a* of the bidirectional counter 188, and through the outputs 190*a* is connected with the inputs of the device 189.

Such arrangement of the counter 177 provides for (in case of deenergization) preserving the reading of the bidirectional counter 188 for the corresponding control unit.

Figure 17:
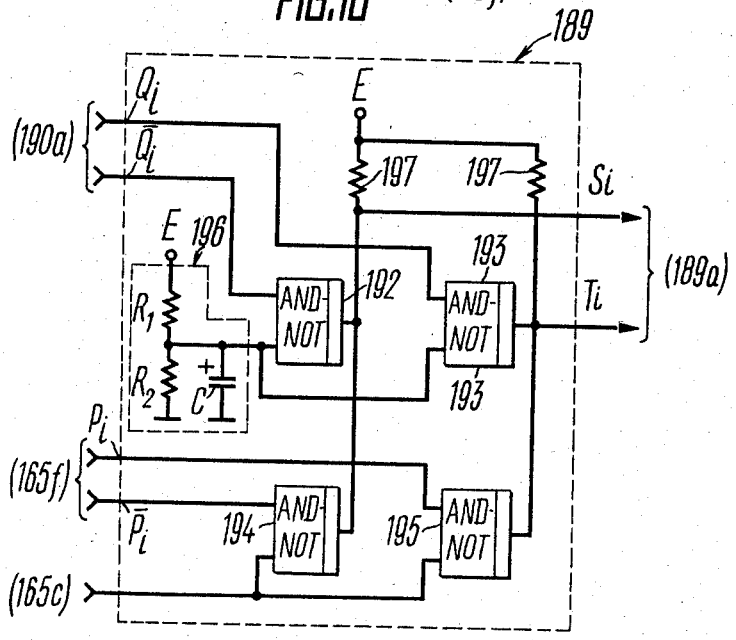
FIG. 17 is a basic circuit diagram of one of the stages of the device for initial setting of the bidirectional instruction coding means in the programmed logical control unit of the apparatus of the invention.

It is clear that the number of the outputs 177*a* corresponds to the numbers of bits of the memory of the bidirectional counter 188. Accordingly the device 189 has the same number of outputs 189*a*. The memory 190 has the same number of bits. Each stage of the memory has two outputs, direct and inverse, connected to the inputs designated, respectively, $Q_i$ and $\overline{Q}_i$ of the device 189 (FIG. 17). The outputs 165*f* of the control panel 165 also consist of a direct output and an inverse output. Connected to these latter are the inputs of the device 189 designated, respectively, by $P_i$ and $\overline{P}_i$. FIG. 17 shows a basic circuit of a cell of the device 189 for an initial setting of the bidirectional counter 188. The number of such cells in the general circuit of the device 189 corresponds to the number of stages of the bidirectional counter 188.

Index i in the circuit indicates the stage with ordinal number i which is used to denote any natural number.

The device 189 comprises AND-NOT gates 192, 193, 194, and 195 with an open collector. One of the inputs of the gate 192 is an input $\overline{Q}_i$ of the device 189, and, similarly, one of the inputs of the gate 193 is an input $Q_i$. By the other input the gates 192 and 193 are connected to a direct current source E through a pulsed signal shaper 196 comprising a resistor $R_1$ and a resistor $R_2$, and a capacitance C.

One of the inputs of the gate 194 is an input $\overline{P}_i$ of the device 189, and the input of the gate 195 is an input $P_i$. Through their other input the gates 194 and 195 are connected to the input of the device 189 connected with the output 165*c* of the control panel 165.

An output $S_i$ connected with the outputs of the gates 192 and 194 connected through a resistor 197 to a constant voltage source E and an output $T_i$ connected with the outputs of the gates 193 and 195 connected through a simpler resistor 197 to the same source E are the outputs 189*a* of the device 189.

The commutator 181 (FIG. 18) comprises AND-NOT gates 198, 199, and 200.

The inputs of the gate 198 through the inputs of the commutator 181 are connected, respectively, to the outputs 178*a* of the timer 178 and to the outputs 179*a* of the wait program block 179 and to the outputs 180*a* of the clock program block 180. The output 198 is the output 181*a* of the commutator 181.

The inputs of the gate 199 through the inputs of the commutator 181 are connected to the output 180*a* of the clock program block 180. The output of the gate 199 is connected to one of the inputs of the gate 200 whose two other inputs are connected through the inputs of the commutator 181, respectively, with the output 178*a* of the timer 178 and with the output 179*a* of the wait program block 179. The output of the gate 200 is the output 181*b* of the commutator 181.

The clock driver 183 comprises D flip-flops 201 and 202 (FIG. 19), AND-NOT gates 203,204,205,206,207,208,209, and an integrating circuit 210.

The inputs C of the D flip-flop 201 and an input D of the D flip-flop 202 are the inputs of the clock driver 183, connected, respectively, to the outputs 182*a* and 186*a* of the sensor program block 182 and of the crystal oscillator 186. Connected to the input of the clock driver 183 linked to the output 186*a* of the crystal oscillator 186 are also both inputs of the AND-NOT gate 203. The input of the clock driver 183 connected to the output 165*d* of the control panel 165 is one of the inputs of the AND-NOT gate 209. Connected to the input of the clock driver 183 linked to the output 184*b* of the trigger shaper 184 are an input R of the D flip-flop 202 and one of the inputs of the AND-NOT gate 207. Inputs S and D of the D flip-flop 201 and an input S of the D flip-flop 202 are connected through the resistor 197 to the constant voltage source E. The output 183*a* of the clock driver 183 is the output of the AND-NOT gate 205 electrically connected by one of its inputs with the output of the D flip-flop 202 through the gates 204 and 205. The output 183*b* of the clock driver 183 is an output of the AND-NOT gate 209 connected through one of its inputs of the output of the AND-NOT gate 205. The output of the D flip-flop 202 is connected to the input R of the D flip-flop 201 through the AND-NOT gate 206, integrating circuit 210, and the AND-NOT gates 207 and 208.

Figure 20:
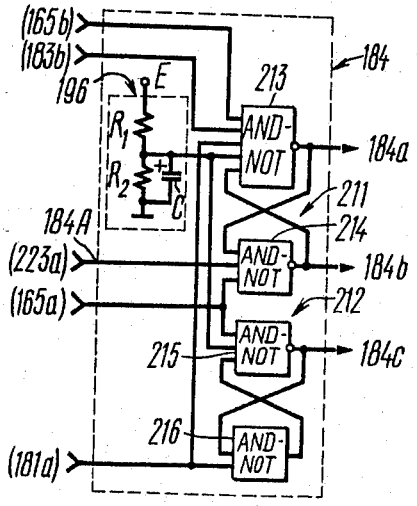
FIG. 20 is a basic circuit diagram of the trigger shaper in the programmed logical control unit of the apparatus of the invention.

The trigger shaper 184 whose basic circuit is shown in FIG. 20 of the drawings comprises RS flip-flops 211 and 212 comprising the AND-NOT gates 213,214,215, and 216.

On one of the inputs of the trigger shaper 184 which is an input of the gate 213 connected to a direct current source E, there is provided a pulsed signal shaper 196 comprising a resistor $R_1$ and a resistor $R_2$ and a capacitance C. Other inputs of the trigger shaper 184 are the following:

input of the gate 213, connected to the output 183*b* of the clock driver 183;

input of the gate 213, connected to the output 165*b* of the control panel 165;

common input of the gates 214 and 215, connected to the output 165*a* of the control panel 165;

common input of the gates 213 and 216, connected to the output 181*a* of the commutator 181.

In addition, the gate 214 has a gate 184A to be connected to other components of a corresponding control unit. The outputs of the trigger shaper 184 are the following:

input 184*a*, which is one of the outputs of the RS flip-flop 211. The output 184*a* serves to produce a "Start" signal to the blocks of the programmed logical control unit 175, said blocks being connected to said output 184*a*;

output 184*b*, which is an inverse output of the RS flip-flop 211. The output 184*b* serves for producing a "Stop" signal to the blocks of the programmed logical control unit 175, said blocks being connected to said output 184*b*;

output 184*c*, which is an output of the RS flip-flop 212. The output 184*c* serves for producing a "Time" signal to the display unit 185 after the preset time of accomplishing a corresponding instruction has elapsed.

For simplicity reasons the above examples relate to the most simple way of realization of the blocks of the programmed logical control unit 175. It will be understood by those skilled in the art that each of these blocks individually as well as said unit as a whole may be constructed in any other suitable manner, particularly by employing microprocessors. This also relates to other components of the control system of the apparatus of the invention, described hereinbelow as a modification in which the functions thereof are disclosed in the most illustrative manner.

The control unit 114 (FIG. 21) comprises the programmed logical control unit 175. One of the inputs 182A of the unit 175 is connected to a device 217 for determining phase difference. The device 217 is electrically connected through an amplifier 218 and a limiter 219 with outputs 135*a* and 135*b* (FIG. 12) of the output windings 157 and 158 of the sensor 135. Through its other input, which is a reference input, the device 217 is connected to the output of the frequency divider 220. Used as the device 217 is a device similar to that described in an article by R. E. C. Abdel Aala "Tsifrovoy fazometr s obnovleniem informatsii v kazhdom periode", "Elektronika", 1981, New York, McGraw-Hill Publishers, No. 19, v. 54, pp. 156 to 157. By its input the divider 220 is connected to the output 186*d* of the crystal oscillator 186 incorporated in the programmed logical control unit 175, and by its output electrically connected through an amplifier 221 with the excitation winding 156 of the sensor 135 (FIG. 12). The outputs of the amplifier 221 are the outputs 114*a* and 114*b* of the control unit 114.

Figure 21:
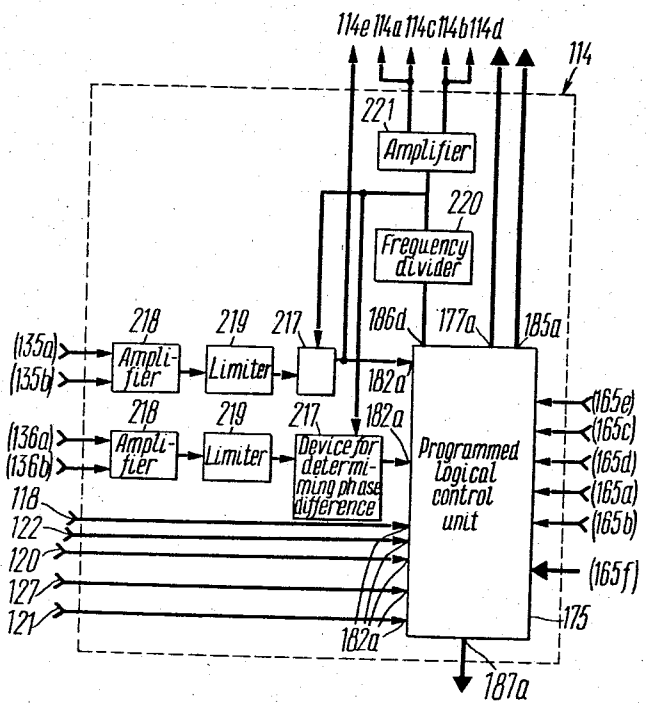
FIG. 21 is a block diagram of a control unit for controlling raising and lowering operations in the apparatus of the invention.

The same set of the components 217 to 221 in the control unit 114 serves for connecting the windings 160 and 162 (FIG. 13) of the sensor 136 to said control unit 114. The outputs of the amplifier 221 (FIG. 21) intended to be connected to the winding 162 of the sensor 136 (FIG. 13) are the outputs 114*c* and 114*d* of the control unit 114 (FIG. 21).

One of the outputs of the device 217 electrically connected with the sensor 135 is the output 114*e* of the control unit. The remaining inputs and outputs of the control unit 114 are the inputs and outputs of the programmed logical control unit 175 incorporated therein. The inputs 182*a* of the sensor program block 182 incorporated in the programmed logical control unit 175 are intended for connecting the sensors 118, 120, 127, 121, and 122.

The control unit 115 (FIG. 22) comprises the programmed logical control unit 175. The inputs of the unit 175 which are the inputs of the unit 115 serve to connect the sensors 121, 119, 128, 133, 134, 127, 131, 132, 135 and the output 114*e* of the unit 114 to said unit 115.

Figure 23:
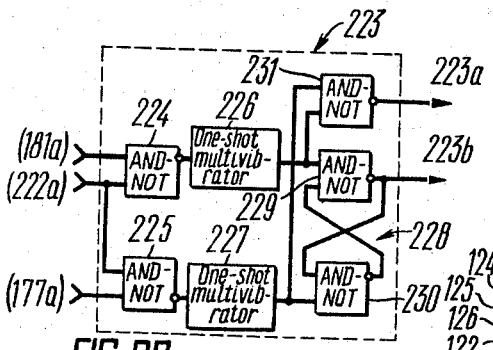
FIG. 23 is a basic circuit diagram of a control signal conditioner in the control unit for controlling the automatic tong of the apparatus of the invention.

The control unit 115 incorporates the recycle counter 222 connected to the output 181*a* of the commutator 181 of the programmed logical control unit 175, and the control signal conditioner 223 is connected through one of its inputs with the same output 181*a*, through another, with the output of the counter 222, and through still another, with the output 177*a* of the counter 177 of the unit 175. The outputs of the control signal conditioner 223 are connected to the inputs 184A of the trigger shaper 184 and to the inputs 178A of the timer 178 (FIG. 15) in the programmed logical control unit 175. The counter 222 (FIG. 22) is structurally similar to the counter 177 of the programmed logical control unit 175. The control signal conditioner 223 (FIG. 23) comprises AND-NOT gates 224 and 225 connected through one-shot multivibrators 226 and 227 to a RS flip-flop 228 including AND-NOT gates 229 and 230.

The gates 224 and 225 are connected by one of the inputs thereof. This common input is an input of the control signal conditioner 223, connected to an output 222*a* of the counter 222. Other inputs of the gates 224 and 225 are also the inputs of the control signal conditioner 223, the input of the gate 224 being electrically connected with the output 181*a* of the programmed logical control unit 175, and the input of the gate 225, with the output 177*a* of said unit 175.

The output 223*b* of the control signal conditioner 223 connected to the input 189*b* is an output of the RS flip-flop 228, and the output 223*a* is an output of an AND-NOT gate 231 connected through its inputs to the outputs of the one-shot multivibrators 226 and 227.

The presence of the above-described recycle counter 222 and the control signal conditioner 223 in the control unit 115 makes it possible to automatically repeat (as shown hereinbelow) unscrewing the drill string 8 if some defects of the screw joint prevent the unscrewing operation from being carried out. The remaining inputs and outputs of the control unit 115 coincide with respective inputs and outputs of the unit 175.

The control unit 116 (FIG. 24) comprises the programmed logical control unit 175 to whose inputs 182A, which are the inputs of the unit 116, the sensors 122, 118, 119, 121, 125, 129, 130, and 137 are connected. The remaining inputs and outputs of the unit 116 also coincide with the inputs and outputs of the unit 175 incorporated in said unit 116.

The control unit 117 (FIG. 25) comprises the programmed logical control unit 175. The outputs 177*a* of the programmed logical control unit 175 are electrically connected (from the counter 177) with the counter 232 of the pipes 21 (FIG. 1) or of the rods 35 (FIG. 3) and with the counter 233 (FIG. 25) of the shelves of the storage rack 54 or 55 (FIGS. 6 and 7). The input of the latter (FIG. 25) is connected to the output of the counter 232 through an AND gate 234, and some of the inputs of the AND gate 234 are connected to the outputs 177*a*. The counter 232 is connected with the outputs 177*a* of the programmed logical control unit 175 through an AND gate 235. One of the inputs of the AND gate 235 is connected to the output 183*a* of the clock driver 183 (FIG. 15) of the programmed logical control unit 175. The counters 232 and 233 (FIG. 25) have inputs (which are the inputs of the control unit 117) connected, respectively, to the outputs 165*g* and 165*h* of the control panel 165 (FIG. 10). The outputs 165*g* and 165*h* are intended for positioning a preset number of the pipes 21 (or the rods 35) (FIGS. 1 and 3) on a corresponding shelf 72 or 73 of the storage rack 54 or 55 (FIGS. 6 and 7) and a number of the shelves being charged of a corresponding storage rack.

Figure 15:
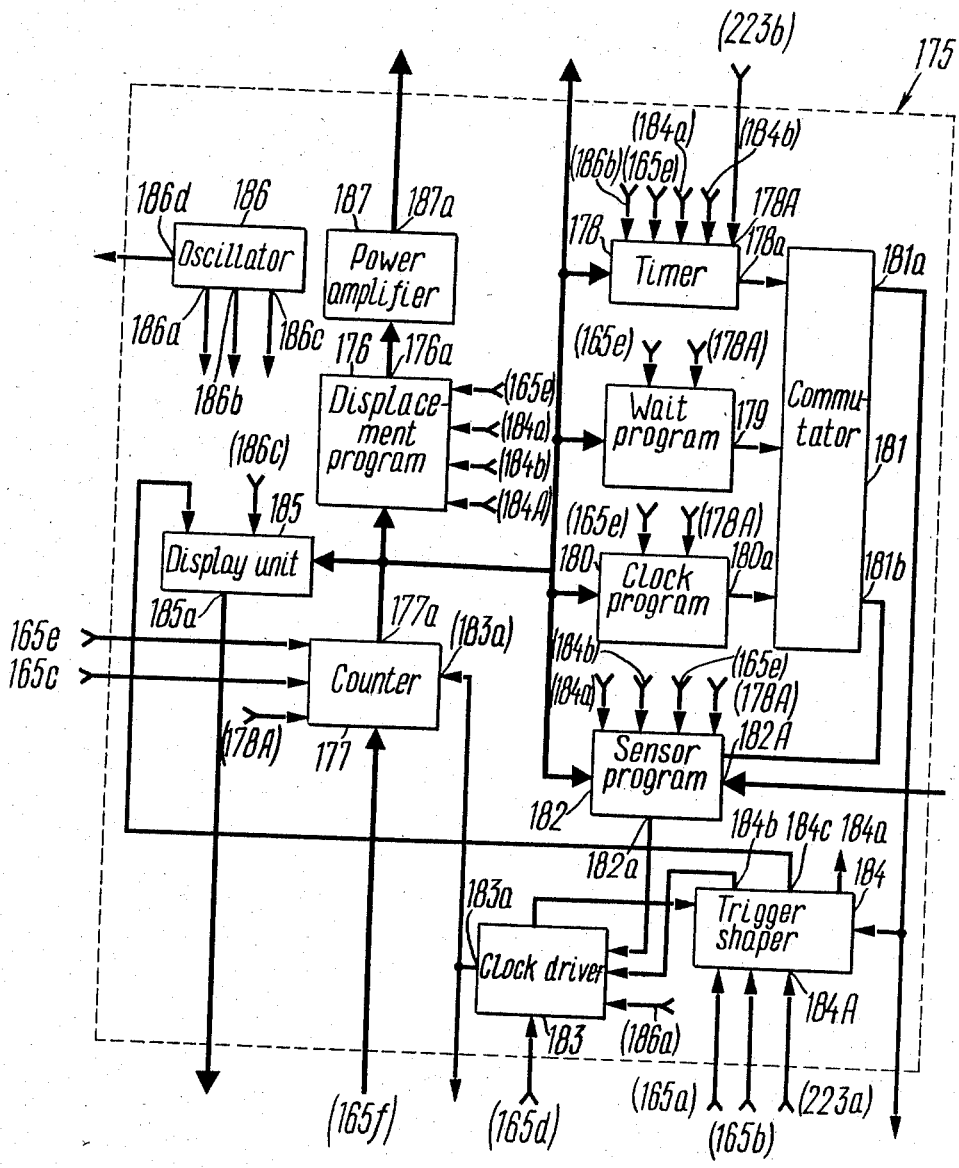
FIG. 15 shows a block diagram of the programmed logical control unit in the apparatus of the invention.
Figure 16:
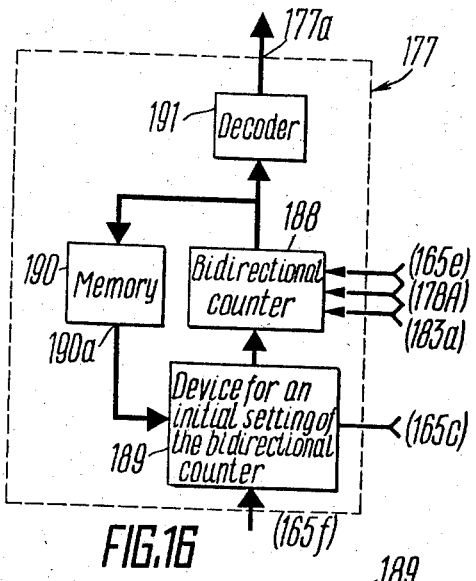
FIG. 16 shows a block diagram of a counter in the programmed logical control unit of the apparatus of the invention.

Structurally, the counters 232 and 233 (FIG. 25) are similar to the counter 177 of the programmed logical control unit 175 (FIG. 16). At the output 117*a* (FIG. 25) of the control unit 117, there are provided a displacement program block 236 and a power amplifier unit 237 which are similar to the corresponding blocks 176 and 187 of the programmed logical control unit 175 (FIG. 15). The counters 232 and 233 are electrically connected through the blocks 236 and 237 with the hydraulic cylinders 78 (FIG. 8) of the drives of the shelves 73 of the storage racks 54 and 55.

The remaining inputs and outputs of the control unit 117 (FIG. 25) coincide with the inputs and outputs of the programmed logical control unit 175, the inputs 182A serving to connect the sensors 123, 124, 125, 126, 129, 130, 122 and 128 to the control unit 117.

The control units 114 to 117 of the apparatus of the present invention are disposed in a case 238 mounted on the platform 5 of a vehicle (FIG. 1).

It is to be noted that the above described control system divided into control units 114 to 117 is convenient from the point of view of its repair and operation when being adjusted, but such an arrangement is not obligatory. A modification of the apparatus is possible to incorporate a control system which includes one programmed logical control unit whose functional diagram corresponds to that shown in FIG. 15, and a control algorithm realized by said diagram that corresponds to the operation program of the apparatus.

The preparation of the apparatus of the invention for operation consists in that both platforms of the vehicle are mounted near the well and by means of jacks are adjusted so that the axes of the openings defined by closed grippers of the clamping means of all the components of the apparatus in their operation positions coincide with the axis of the well. The support beams 65 (FIG. 6*b*) of the storage racks 54 and 55 are rotated about the vertical pivot pins 67 by means of the hydraulic cylinders until each such support beam, makes an angle of 180° with the pivot shackle 66 (FIG. 6*a*) and thereby forms the support beam 59. In this position the above components are get fixed. Thereafter the support bar 59 is rotated about the horizontal pivot pin 60 so that it acquires a position close to a horizontal one, in which position said bar 59 is fixed with the jack 62.

The above-described apparatus operates in accordance with two technological cycles, one of which involves raising and disassembling the drill string, the other with assembling the same drill and lowering it into the well. An instruction "Raising" corresponds to the first cycle, and to the other, "lowering".

Figure 6A:
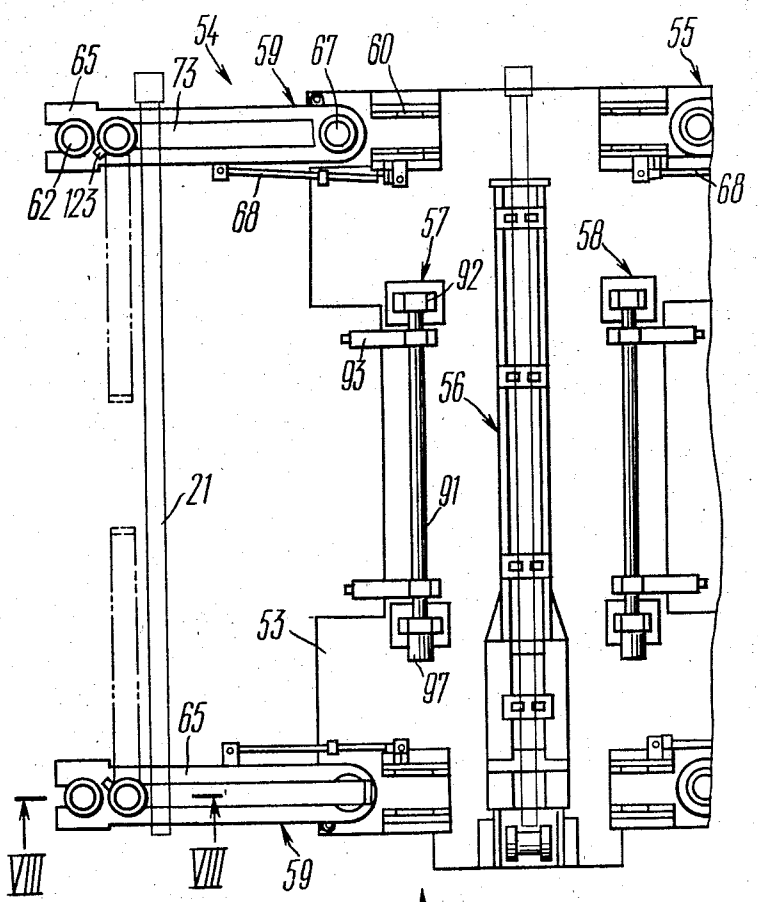

When carrying out the raising operations the components of the apparatus occupy the following initial position:

elevator 9 (FIG. 1) is in the upper position and the grippers 42 thereof are opened;

grippers 50 of the spider 11 are closed and hold the drill string 8 of pipes (or rods);

automatic tong 7 is withdrawn to a non-operating position;

manipulator 56 is in a horizontal position, the grippers 111 thereof being opened;

storage rack 54 for the pipes 21 (FIG. 7) or the storage rack 55 for the rods (depending on the manipulation of either pipes or rods) is inclined in the direction from the manipulator 56;

movable shelves 73 of the storage rack 54 or 55 are withdrawn to a non-operating position (FIG. 6*a*);

booms of the pipe transfer device 57 for transferring the pipe 21 (FIG. 7), or the rod transfer device 58 for transferring the rod 35, are withdrawn to a corresponding storage rack 54 or 55.

Before operation, the toggle switch 171 of the control console 164 (FIG. 14) is set in position "Raising", a corresponding switch arm (not shown) is set in one of the positions "Pipes" or "Rods" which is conditioned by the fact whether a string of pipes or a string of rods is to be taken from the well, the switch arm 170 is set into position corresponding to a desirable manner of raising: either automatically or manually. Then with the aid of a corresponding switch arm, not shown in the drawing, a power source, not shown as well, is switched on. From the output 165*e* of the control panel 165 a signal "Raising" is applied to the corresponding inputs of the control units 114 to 117 (FIGS. 21, 22, 24, 25). In each of said control units said signal is applied to the corresponding inputs of the counter 177 (FIG. 15), blocks 176, 179, 180, 182, and timer 178. The counter 177 is set for direct counting.

In the displacement program block 176 there are switched on the inputs of the cells which, in accordance with a preset program, switch electrohydraulic valves of the hydraulic distributors acting upon the drives of the above-described component parts of the apparatus of the present invention.

The wait program block 179 and the clock program block 180 select commands produced, respectively, in response to the signals of the sensors or after some lapse of time. The sensor program unit 182 switches the inputs of the sensors in accordance with the program of their operation at the time when the drill string is being raised up.

If the switch arm 170 (FIG. 14) was set to a position corresponding to manual operation, a signal from the output 165*d*, after the power supply, is delivered in each of the control units 114 to 117 (FIG. 10) to the input of the AND-NOT gate 209 (FIG. 19) of the clock driver 183, thereby connecting the output 183*b* of the clock driver 183 to the input of the RS flip-flop 211 (FIG. 20) of the trigger shaper 184. This ensures the operation of each of the control units 114 to 117 (FIGS. 10, 21, 22, 24, and 25) during the time period of carrying out the command.

If the switch arm 170 (FIG. 14) was set to a position corresponding to a manual mode of operation, a signal from the output 165 is not supplied to the input of the AND-NOT gate 209 (FIG. 19), and the output 183 of the clock driver 183 will not connect with the respective input of the trigger shaper 184, which ensures a continuous cycle of operation of the programmed logical control unit 175 in each of the units 114 to 117 (FIG. 10).

The shaper 196 in the device 189 for an initial setting of the bidirectional counter 188 (FIG. 17) being energized, the capacitance C of each of the control units 114 to 117 (FIG. 10) is charged and shapes an interrogation signal of the AND-NOT gates 192 and 193 whose other inputs, as mentioned hereinabove, are connected to the memory 190 digit-to-digit, which memory stores a code corresponding to the position of the bidirectional counter 188 prior deenergizing the shaper 196. The interrogation signal sets the bidirectional counter 188 to a position similar to that stored by the memory 190.

If a necessity arises to change an initial position of the bidirectional counter 188, for instance, if a previous cycle was interrupted and a new one is to be commenced (in addition, such a necessity often occurs in a manual mode of operation or when being adjusted), the operator sets the switch 172 on the control panel 165 of the control console 164 (FIG. 14) to a position which corresponds to a number (code) of a required command (at the beginning of the technological cycle this command is the first). When the button 169 is depressed, a signal is delivered from the output 165*c* of the control panel 165 to a corresponding input of the device 189 (FIGS. 16 and 17), said signal interrogating the AND-NOT gates 194 and 195 connected digit-by-digit, as mentioned before, to the outputs 165*f* of the switch 172. As a result, on the outputs 189*a* of the device 189 a signal occurs setting the bidirectional counter 188 to a position corresponding to a number of a command, displayed on the control panel 165 (FIG. 14).

In a similar manner the well element counter 232 (FIG. 25) and the shelf counter 233 of the control unit 177 for controlling corresponding switches 173 and 174 (FIG. 14) of the control panel are set to preset positions.

In the trigger shaper 184 (FIG. 15) of the control unit 175 of each of the control units 114 to 117 (FIGS. 21, 22, 24, and 25), the flip-flop 211 (FIG. 20) being energized is set to a zero position in which the trigger shaper 184 produces a command "Stop" at the output 184. Such being the case, the blocks 176, 179, 180, 182, and the timer 178 do not produce signals, and the display unit 185 displays through the indicating panel 166 an initial or preset position of the counter 177.

Figure 14:
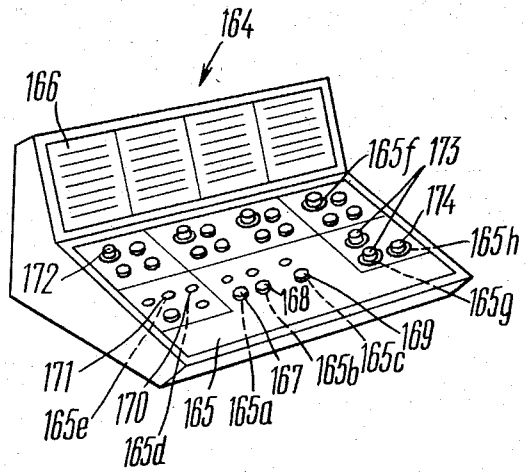
FIG. 14 is a diagrammatical representation of the control console in the apparatus of the invention.

To start the operation of the apparatus, the operator depresses the button 167 on the control panel 165 (FIG. 14).

By this signal arriving to the input of the trigger shaper 184 (FIG. 15) in the unit 175 of each of the control units 114 to 117 (FIGS. 21, 22, 24, 25) from the output 165*a* of the control panel 165 (FIG. 14), RS flip-flop 211 (FIG. 20) is set. A corresponding signal from the output 184*a* of the trigger shaper 184 puts into operation the timer 178, which counts the time of realization of the first command. Simultaneously, the same signal opens the outputs of the displacement program block 176, which in accordance with the output signal of the counter 177, through the power amplifier 187, puts into operation the electrohydraulic valves acting upon the drives of the components participating in the realization of a given command. The first command realized by the control unit 114 (FIG. 21) is delivered to the drive 12 (FIG. 1), which moves the carriage 10 with the elevator 9. The elevator moves down until the sensor 135 disposed on the carriage 10 moves against the threaded sleeve 28 disposed on the upper end of the string 8 clamped in the spider 11. In the initial position of the sensor 135, antiphase voltages occur between the oppositely connected excitation winding 156 and the output windings 157 and 158 (FIG. 12). When the sensor 135 moves from above upon the threaded sleeve 28 of the string 8 (FIG. 12), the inductive coupling between the excitation winding 156 and the output winding 158 increases, and the inductive coupling between the excitation winding 156 and the output winding 157 remains at the previous level. As a result, the balance of amplitude and the balance of phase are impaired, and on the outputs 135*a* and 135*b* there occurs voltage varying in amplitude and phase as the sensor 135 moves with respect to the sleeve 28. This voltage is transformed by the amplifier 218 and the limiter 219 (FIG. 21) into unidirectional square pulses arriving at the input of the device 217. To the other input of the device 217 there is delivered a reference voltage from the output of the frequency divider 220. The device 217 operates when a preset threshold of phase shift occurs. From the output of the device 217 the signal is delivered to the input 182A of the unit 175 in the control unit 114.

Figure 18:
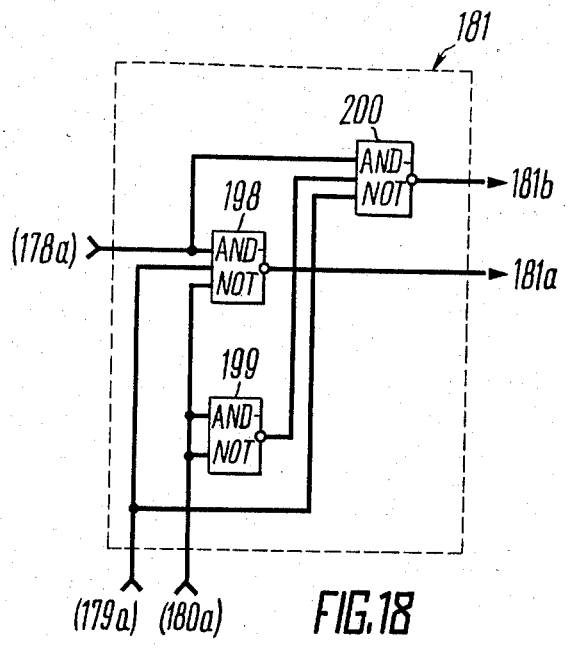
FIG. 18 is a basic circuit diagram of the commutator in the programmed logical control unit of the apparatus of the invention.
Figure 19:
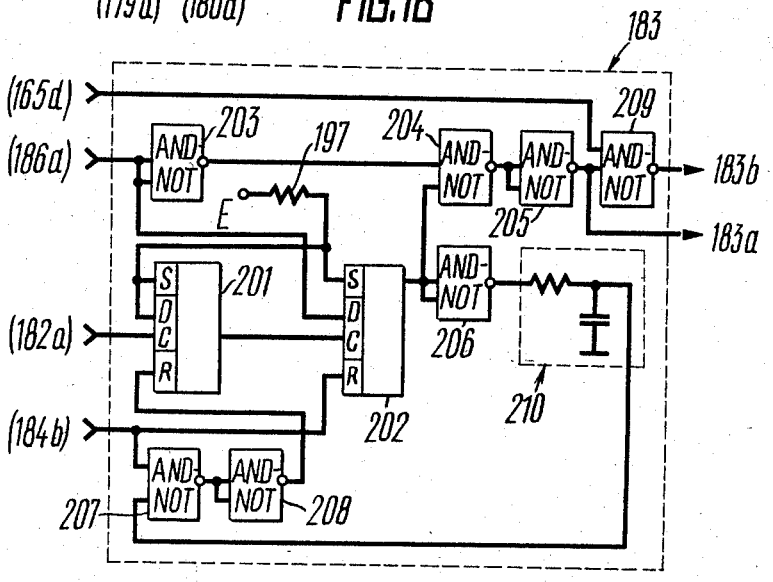
FIG. 19 is a basic circuit diagram of the clock driver in the programmed logical control unit of the apparatus of the invention.

If in accordance with the wait program preset by the block 179 (FIG. 15) the following (in this case, the second) command should be delivered only by the signal of a sensor (in this case, the sensor 135), a signal from the output 179*a* of said block (a code of this command is dialed in this block) will not arrive at the corresponding inputs of the gates 198 and 200 of the commutator 181 (FIG. 18), which prevents the signals from arriving at the outputs 181*a* and 181*b*. Therefore, the block 182 (FIG. 15) having received a signal on the input 182A from the sensor 135 applies a signal from the output 182*a* to the input C of the D flip-flop 201 of the clock driver 183 (FIG. 19). The D flip-flop is set. From its output signal and in the course of passing of the leading edge of a pulse produced by the crystal generator 186 the D flip-flop 202 operates and resets the D flip-flop 201 through the integrating circuit 210 and the AND-NOT gates 207 and 208 to a zero position. When the D flip-flop operates, there is formed a single pulse at the output of the AND-NOT gate 204, which pulse passes through the AND-NOT gate 205 to a corresponding (time) input of the counter 177 (FIGS. 15, 16) and switches it to another position.

If the switch arm 170 (FIG. 14) of the control panel 165 was preliminarily set to a position "manual", a signal from another output 183*b* (FIG. 19) simultaneously with said above output signal of the clock driver 183 is applied to the RS flip-flop 211 of the trigger shaper 184 (FIG. 20). The RS flip-flop 211 is switched to a zero position and, as a result, the trigger shaper produces a command "Stop" from the output 184*b*, thereby bringing the operation of the apparatus to a stop.

To carry out the following command, the operator should again depress the "Start" button. This takes place each time when a following command has been carried out. If the switch arm 170 of the control panel 165 (FIG. 14) occupies a position corresponding to the automatic mode of operation, the clock driver 183 (FIG. 15) produces no signal form the output 183*b*, and the second command follows the first without bringing the unit 175 to a stop.

After switching over the counter 177*a*, the signal from its output enters the displacement program unit 176 sending a command via the power amplifier unit 187 to the drive 12 (FIG. 1) which brings the elevator 9 to a standstill. At the same time, this very signal is delivered to the valve spool 140 (FIG. 11), which is an electrohydrovalve, and the latter, when moved, connects the pipe 149 (via pipe 147) with the rear end of the hydraulic cylinder, which is the drive 43 for closing and opening of the grippers 42 of the elevator 9. When the spider 11 is closed the check valve 141 is open and connects the pipe 149 with the delivery line 143 connected with the pump unit 138. Under the pressure of the pumped hydraulic liquid into the above specified cavity of the hydraulic cylinder 43, the piston of the latter moves downwards, and thereby the grippers 42 of the elevator 9 close thus embracing the string 8. The code of the command following the above operations was set in the clock program block 180 of the programmed logical control unit 175 of the control unit 114 (FIG. 15). From the output terminal 180*a* the corresponding signal is delivered to the inputs of the AND-NOT gates 198 and 199 (FIG. 18) of the commutator 181. The input of the AND-NOT gate 200 (to which a signal from the output 178*a* of the timer 178 is delivered, FIG. 15) gets switched through the output 181*b*, and the signal from the latter output enters the sensor program block 182. The latter supplies a signal to the clock driver 183 which switches the counter 177 to produce the following command. This command via the 176 and 187 units enters the distribution valve 139 (FIG. 11), which in the process of its displacement connects the rear end of the hydraulic cylinder (which is the drive 52 for closing and opening the grippers 50 of the spider 11) with the hydraulic line 145. The piston of the hydraulic cylinder 52 moves upwards, thus opening the wedge grippers 50. The rest 144 being rigidly fixed with the piston rod of the hydraulic cylinder 52, also moves upwards thus releasing the spool 142, which under the action of the spring of the check valve 141 moves upwards and shuts the pipeline 149 thereby ruling out the possibility of opening the elevator 9 in case the pressure drops in the hydraulic system. The sensor 127, being displaced with the spool 142, produces a signal "elevator closed, spider opened" supplied to the input terminal 182A of the control unit 114 (FIG. 21). The next command is shaped by the programmed logical control unit 175 of the control unit 114 (FIG. 15) in response to the signal from the above time control sensor, and the code of this command does not enter the unit 180. The blocks 179 and 180 produce one signal delivered to the input of the AND-NOT gates 198 and 199 (FIG. 18). The other input of the AND-NOT gate 198 receives a signal from the timer 178. As a result at the output of the AND-NOT gate 198 there appears a signal prior to the time of execution of the command. If the sensor 127 (FIG. 11) operates with time then the shaping of the following command by the unit 175 (FIG. 15) takes place as above. In case of failure in the hydraulic system of the apparatus, or in the drives for closing and opening of the grippers of the elevator 9 or the spider 11 (FIGS. 1 and 11), the sensor 127 fails to operate and the signal from the output terminal 181*a* (FIGS. 15 and 18) enters the inputs of the RS flip-flops 211 and 212 (FIG. 20) of the trigger shaper 184 and sets these flip-flops into zero position, thereby disconnecting units 176 and 182 (FIG. 15) as well as the timer 178. When the signal from the output 184*c* (FIG. 20) of the trigger shaper 184 (FIG. 15) enters the indicating unit 185, the latter displays on the control console 164 (FIG. 14) the number of the command which brought about the failure to operate the sensor. An operator, having remedied the trouble, will resume operation of the apparatus by depressing the "start" button 167.

Figure 24:
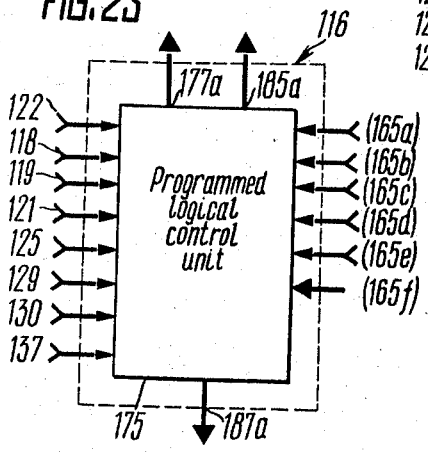
FIG. 24 is a block diagram of a manipulator control unit in the apparatus of the invention.

When the command produced by the control unit 114 (FIG. 21), shaped when the signal that arrives from the sensor 127, enters the drive 12 (FIG. 1), then the elevator 9 with the drill string 8 of pipes 21 or rods 35 (FIG. 3) moves upwards. When the elevator 9 reaches the sensor 119 (FIG. 1) which occupies an intermediate position between the position sensors of the elevator 9, then from this sensor the signal enters the control unit 115 for controlling the automatic tong 7 (FIG. 22) and the control unit 116 for controlling the manipulator 56 (FIG. 24). The signal enters the inputs 182A of the unit 175 of these control units 115 and 116 which, in a similar manner as was described for the unit 175 of the unit 114, shape the following commands.

From the output 187*a* of the unit 115 (FIG. 22) the command enters the drive 13 for transverse displacement of the automatic tong 7 (FIGS. 1 and 2), the drive displaces the slide 31 with the tong in the direction of the well axis (FIG. 1).

When the automatic tong 7 reaches its operating position the sensor 121 (FIG. 2) produces a signal to the control unit 115 (FIG. 22), which switches off the drive 13 (FIG. 2).

From the output 187*a* of the unit 116 (FIG. 24) the command, shaped when the signal from the sensor 119 operates, enters the drive 109 (FIG. 1), the latter starts to displace the manipulator 56 from the horizontal into the vertical position. This displacement goes on till the sensor 122 operates, in response to its signal the unit 116 switches off the drive 109.

When the lower threaded sleeve 28 of the upper pipe of the string 8 enters the position sensor 136 of the pipe 21, the sensor being mounted on the automatic tong 7, the induction between the excitation winding 161 and the output winding 163 increases, the voltage phase changes, and the device 217 for determining phase difference (FIG. 21), electrically connected with the sensor 136, produces a signal (in a similar manner as in the circuit of the sensor 135) entering the entrance 182A of the unit 175 in the control unit 114. The latter sends a command to the drive 12 for vertically moving the upper means (FIG. 1), which stops the operation of the elevator 9, following which the next command from the unit 114 again enters the same drive and valve spools 139 and 140 (FIG. 11). The drive 12 lowers the elevator 9 (FIG. 1), and the valve spool 139 on its way makes hydraulic liquid enter from the pumping unit 138 via the delivery line 146 into the hydraulic cylinder 52. The grippers 50 of the spider 11 close, and the rest 144, pushing the spool 142 covers it to shift to connect the pipes 149 and 143, which makes it possible to open the grippers 42 of the elevator 9 with the help of the drive 43 due to the corresponding movement of the spool 140. When the spool 142 is being displaced the sensor 127 produces a signal "elevator opened, spider closed".

The lowering of the elevator 9 takes place till that moment when the grippers 42 (FIG. 1) get lower than the upper threaded sleeve 28, and the end of the latter at the same time enters the sensor 135. In response to the signal of the said sensor, delivered to the unit 114 (FIG. 21) as described above, the drive 12 gets switched off (FIG. 1) and the elevator 9 comes to a standstill. At the same time, from the output 114*e* of the unit 114 (FIG. 21) the signal is forwarded to the unit 115 for controlling the automatic tong 7 (FIG. 22), which in the case of operation of the automatic tong 7' of the apparatus and if the input 182A receives the above signal from the sensor 127 to close the elevator, then this signal produces a command to the drive 29 (FIG. 2) which closes the grippers of the locking device 16. The time needed to execute this command elapses the unit 115 (FIG. 22), produces a command to the drive 24 (FIG. 2) which closes the grippers 23 (FIG. 2) of the low-torque device 15, and the following command of the unit 115 (FIG. 22), is fed to the drive 19 (FIG. 2) which closes the grippers 18 of the high-torque device 14 when the grippers embrace the pipe 21 which is being unscrewed. Then the unit 115 (FIG. 22) supplies the command to the drive 20 for rotation of the high-torque device 14 (FIG. 2), which unfastens the threaded coupling. The torque, gained by the device 14, is regulated by the torque sensor 131 (FIGS. 2 and 10). When the torque drops to a certain (given) value, this sensor operates, and if the angle of turning the pipe (rod) being unscrewed relative to the string 8 reaches the assigned value, then the angle-data transmitter 132 operates, and following the signal produced by the sensors 131 and 132 the unit 115 forwards a signal to the inputs 182A of the unit 175, and as a result a command is fed from the output 187*a* of the unit 115 to the drives 20 and 19 (FIG. 2). The drive 20 gets switched off, and the drive 19 opens the grippers 18 of the high-torque device 15 which fully unscrews the pipe 21. If after a certain period elapses since operation of the drive 20 (counted down by the timer 178, FIG. 15, of the unit 175 which is a part of the control unit 115) the signal fed from one of the sensors 131 and 132 does not arrive at the input terminals 182A of the unit 115 (FIG. 22), the counter 177 (FIG. 15) of the unit 175 produces a signal via the indicating unit 185 to the indication panel 166 (FIG. 14) and simultaneously to the control signal conditions 223 (FIG. 22) in which, via the AND-NOT gate 224 (FIG. 23), there is triggered the one-shot multivibrator 226 making operational the flip-flop 228 which switches the counter 177 (from the output terminal 223*b*), the units 176 and 182, as well as the timer 178 onto the execution of the preceding command, the said flip-flop shapes the "Start" signal at the output terminal 223*a*, as a result of which the unit 175 of the control unit 115 (FIG. 22) shapes the command to open the grippers 18. From the output terminal 177*a* of the unit 175 to the input of the control signal conditioner 223 there is fed a signal via the AND-NOT gate 225 (FIG. 23) that triggers the one-shot multivibrator 227. The latter switches the flip-flop 228 producing a signal from the output terminal 223*b* to the input terminal 178A of the timer 178 (FIG. 15), and connects with this input terminal the inputs of the counter 177 and units 179, 180 and 182. Following the command "Start", shaped by the trigger shaper 184 when a signal is fed to its input terminal 184A, the signal being generated by one-shot multivibrator 227 (FIG. 27) via the output terminal 223*a*, there again takes place the closing of the grippers 18 (FIG. 2) and the repeated switching of the drive 20 (FIG. 2), which exercises the opening of the grippers. This operation can be repeated several times until from both sensors 131 and 132 (FIGS. 2 and 10) the signals will reach the output terminals 182A of the unit 115. In case the maximum torque developed by the drive 20 (FIG. 2) of the high-torque device 14, due to considerable damage of the threaded joints, might prove to be insufficient to unfasten the coupling, then the recycle counter 222 (FIG. 22) after a certain number of cycles (this number is preliminarily ascertained depending upon the condition of the pipes in the drill string 8) produces an inhibiting signal to the inputs of the AND-NOT gates 224 and 225 (FIG. 23), as a result of which the counter 177 (FIG. 15) comes to a standstill, the unit 175 ceases its work, and the decision is to be made by the operator.

Thus a reliable operation of the tong 7' under the automatic mode of operation when disconnecting pipes is envisaged.

The operation of the automatic rod tong 7'' (FIG. 3) does not differ in principle from the above described operation of the automatic pipe tong 7'. The specific feature in unscrewing the string 8 of rods 35, as compared with the string of pipes, lies in that both the unfastening and the final unscrewing of the joint is performed by the swivel head 32, the drive 36 of which is rated for the maximum torque, and the torque sensor 134 during unscrewing produces a signal when the torque reaches its minimum value, i.e. when it gets close to zero. The time to unscrew the joint is based upon the period of operation of the swivel head 32 and is counted down by the timer 178 (FIG. 15) of the unit 175 from the moment the rotation drive 36 (FIG. 3) is put into operation.

When the unscrewing of the threaded joint is completed, the unit 116 for controlling the manipulator 56 (FIG. 24) produces a command to the drive 113 (FIG. 1) which closes the grippers 111 embracing the detached pipe 21, or the rod 35 fixed in the elevator 9 and in the clamping means 22 (FIG. 2) of the low-torque device 15 or in the clamping means 34 (FIG. 3) of the swivel head 32. After a certain period of time sufficiently long for the fastening of the pipe 21 (FIG. 1) or the rod 35 (FIG. 3) by the grippers 111 (FIG. 1), the time being counted down by the timer 178 (FIG. 15) of the unit 175 in the unit 116, the control unit 114 for controlling the raising and lowering operations produces a command to the drive 43 (FIGS. 1 and 11) which opens the grippers 42, and the control unit 115 for controlling the automatic tong 7' (FIG. 22) produces a command to the drives 24 and 29 (FIG. 2) which open, respectively, the grippers 23 and 27 of the low-torque device 15 and the locking device 16. When operating with the rods 35 (FIG. 3) the unit 115 (FIG. 22) produces a command to reverse the drive 36 (FIG. 3), which secures the return of the clamping device 34 of the swivel head 32 into its initial position, and to the drive 41 which opens the grippers 40 of the locking device 33.

Then the unit 115 (FIG. 22) produces a command to the drive 13 for the transverse displacement of the automatic tong 7 (FIGS. 1, 2, and 3) along the slide 31 and into the non-operative position fixed by the sensor 121 from the signal of the latter, the unit 115 (FIG. 22) switches off the drive 13 (FIGS. 2 and 3).

At the same time, the control unit 114 (FIG. 21) produces a command to the drive 12 (FIG. 1) moving the carriage 10 with the elevator 9 upward, and the control unit 116 (FIG. 24) produces a command to the drive 112 (FIG. 1) which moves the grippers 111 upward with the embraced pipe 21 or the rod 35 (FIG. 3), until the pipe 21 (FIG. 1) or the rod 35 (FIG. 3) will not reach in the manipulator 56 (FIG. 1) the strictly determined position set by the sensor 137.

When the elevator 9 coming upward finds itself beyond the limits of the upper end of the pipe 21 (or the rod 35), the sensor 118 operates, and the signal of the latter when it reaches unit 116 for controlling the manipulator 56 (FIG. 24) shapes the command to the driver 109 (FIG. 1) to displace the manipulator 56 into the horizontal position.

Simultaneously, the unit 114 (FIG. 21) in response to the same signal from the sensor 118 produces a command to the drive 12 for vertically moving the upper means (FIG. 1) which shuts off, as a result of which the elevator 9 stops.

When the sensor 122 produces a signal that the manipulator 56 has reached its horizontal position, then if the sensor 121 (FIGS. 2 and 3) produces a signal that the tong 7 is in its non-operative position, then the control unit 114 (FIG. 21) for controlling the raising and lowering operations produces a command to the drive 12 (FIG. 1) to displace the elevator 9 down and repeat the cycle.

Figure 9A:
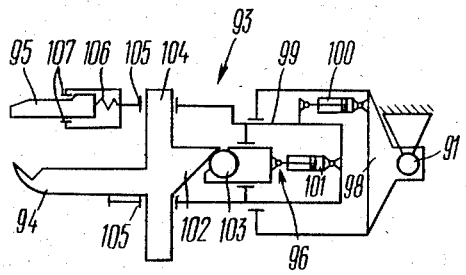
FIGS. 9*a* through *d* are diagrammatical representations of the boom of the transfer device in the pipe racking stand of the invention, the boom being shown in an inoperative position in FIG. 9*a* and in FIG. 9*b* there is shown removal of a well element from the manipulator.
Figure 9C:
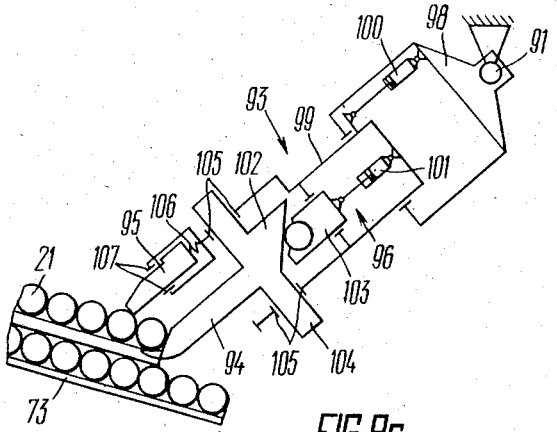
Figure 9B:
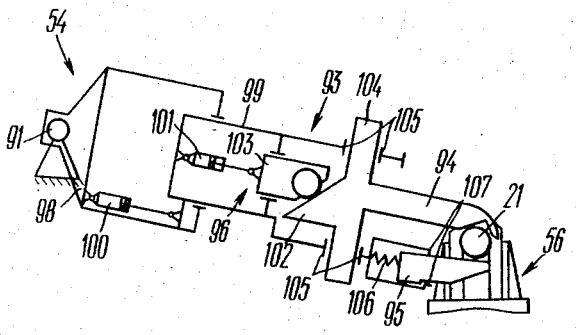
Figure 9D:
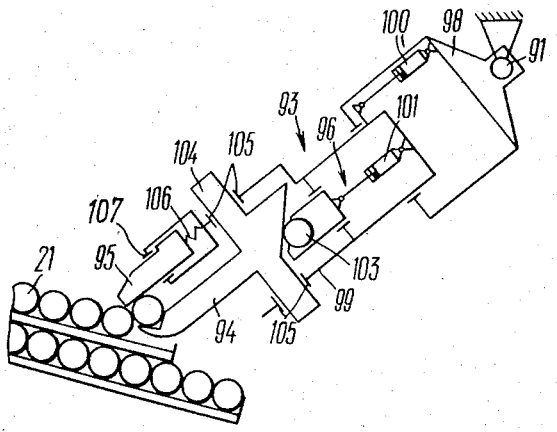

In response to the above signal to the sensor 122, which is also delivered to the control units 116 and 117 (FIG. 10), the drive 109 for moving the manipulator 56 (FIG. 1) shuts off, and the drive 97 for turning the booms 93 (FIG. 6) of the corresponding pipe transfer device 57 or rod transfer device 58 shuts on, and the above booms 93 turn in the direction of the manipulator 56 till the operation of the sensor 125 (FIG. 7), the signal from which having reached the control unit 117 (FIG. 25), shapes commands to the drives 100 and 96 (FIG. 9*b*). The drive 100 fully moves the case 99 out of the holder 98, the gripper 95 being somewhat under the pipe 21 or rod 35 embraced by the grippers 111 of the manipulator 56 (FIG. 1). The piston rod of the hydraulic cylinder 101 (FIG. 9*b*) of the drive 96 by pushing the roller follower 103 thereby makes slide 104 carrying the gripper 94 move along the transfer guideways 105. The gripper 94 moves to the gripper 95, which is restrained against transverse displacement by the longitudinal guides 107, until the outer surface of the pipe 21 or the rod 35 is gripped, following which the sensor 129 or 130 (FIG. 7) produces a signal to the control units 116 and 117 (FIGS. 24 and 25) that the grippers 94 and 95 are closed. Having received this signal the unit 116 (FIG. 24) produces a command to the drive 113 (FIG. 1) which opens the grippers 111 of the manipulator 56. In response to the signal of the sensor 128 regarding the opening of the grippers of the manipulator 56, the unit 117 (FIG. 25) turns on the drive 97 (FIG. 6) and, the latter turns the booms 93 of the corresponding devices 57 or 58 in the direction of the corresponding storage rack 54 or 55. When the booms 93 reach the position of the lower shelf 72 (FIG. 7) the corresponding (in this case the lower) sensor 126 operates and produces a command via the unit 117 (FIG. 25) to the drive 97 (FIG. 6), stopping the turning of the booms 93, and to the drive 96, which opens the grippers 94 and 95. The counter 232 for pipes 21 or rods 35 (FIG. 25) starts counting pipes 21 or rods 35 placed onto the corresponding storage rack 54 or 55 when the signal comes from the sensor 126 (FIG. 7).

The released pipe 21 or rod 35 rolls along the shelf 72 to its lower position under gravity.

All the above stages of operation of the components of the pipe racking stand 2 take place during lowering the elevator 9 (FIG. 1) and during raising the string 8 of pipes and rods by this elevator (in the following cycle of operation of the apparatus).

The described sequence of operations on placement of the pipes 21 or the rods 35 (FIGS. 6 and 7) is repeated until the lower shelf 72 is filled with the predetermined number of pipes 21 or rods 35. For operation of the counter 232 for pipes or rods, the signals are fed to the AND-NOT gate 235 from the output terminals 177*a* and 183*a* of the unit 175 in the control unit 117 (FIG. 25) when the signal is produced from the sensor 123 or 124 (FIG. 6). In the case of the coincidence of the number of pipes or rods on the shelf with the number of pipes or rods set by the counter 173 (FIG. 14) of the control panel 165 for the counter 232, the AND-NOT gate 234 produces a signal changing the state of the counter 233 for shelves, which initiates the counting of the number of the filled shelves of the corresponding storage rack 54 or 55. When the output signal from the counter 233 for shelves is supplied to the displacement program block 236, the latter produces a command via the lower amplifier unit 237 to the hydraulic cylinder 78 (FIG. 8), causing the turning of the supports 74 of the shelf 73 which is directly above the already filled shelf 72 or 73. Each hydraulic cylinder 78 is displaced upward relative to its fixed piston rod 79, and by means of one of the pins 83 fixed to the hydraulic cylinder and that enters into the direct slot 88 of the cylinder sleeve 86, one of the shelves 73 of the storage rack 54 or 55 which is above the previously turned shelf. At the same time another pin 82 of the hydraulic cylinder 78 brought into the curvilinear slot 87 of the sleeve 86 of the shelf 73 following the filled up shelf 72 or 73 while moving upward together with the hydraulic cylinder 78, turns the support 74 of the shelf 73 relative to the column 69 into the operative position (above the shelf 72) fixed by the sensor 123 or 124 positions of the corresponding shelf 73 (FIG. 6), the signal of the latter sensor stops the turning of the support. The turning of the support 74 of the following shelf 73 takes place during the overloading of the next pipe 21 or rod 35 from the manipulator 56 into the device 57 or 58 (FIG. 3) which in its further turning in the direction to the corresponding storage rack 54 or 55 will be stopped by the command from the unit 117 (FIG. 25), produced in response to the signal from one of the sensors 123 or 124 (FIG. 6), and the signal will correspond to the position of the shelf 73 that is brought into the operative position. In a similar manner all the shelves of the storage rack 54 or 55 are being filled up.

Figure 25:
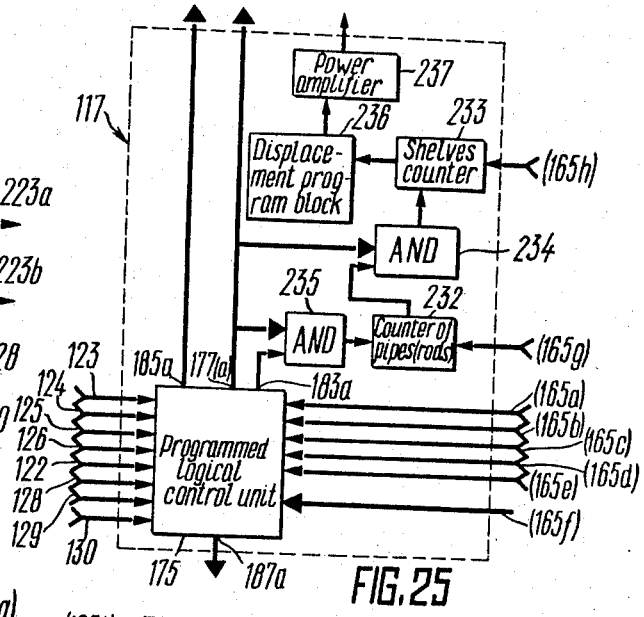
FIG. 25 is a block diagram of a control unit for controlling loading and unloading operations of the apparatus of the invention.

When rearranging the apparatus for operation with pipes 21 or rods 35 of another diameter, the number of pipes 21 or rods 35 to be housed on the shelf of the storage rack 54 or 55 will be different, and therefore the operator will change the number of required pipes or rods at the control panel 165 (FIG. 14), and a signal reflecting the changed number enters the counter 233 for shelves (FIG. 25).

Now the operation of the apparatus during lowering the pipes or rods into the well will be described.

The initial position of the components of the apparatus in the course of lowering the pipes or rods is the following:

elevator 9 (FIG. 1) is in the upper position and the grippers 42 thereof are opened;

grippers 50 of the spider 11 are closed and hold the spring 8 of pipes (or rods);

automatic tong 7 is withdrawn to a non-operating position;

manipulator 56 is in a horizontal position, and the grippers 111 thereof are opened;

storage rack 54 for the pipes 21 (FIG. 7) or the storage rack 55 for the rods 35 (depending on whether pipes or rods are being lowered) is inclined towards the manipulator 56;

movable shelves 73 of the storage rack 54 or 55 are in an operating position and are loaded with the pipes 21 or with the rods 35;

booms 93 with the grippers 94, 95 of the pipe transfer device 57 or with the rod transfer device 58 are adjacent to the upper shelf of the storage rack 54 (55) and are loaded with the pipes (rods).

Before operation, on the control console 164 (FIG. 14) the switch arm is set to the "Lowering" position, a corresponding switch arm (not shown) is set to the "Pipes" or "Rods" position and the switch arm 170 is set to a position corresponding to an automatic or manual mode of operation. Then a power source is connected to the control console 164, whereupon the counters 177 (FIG. 15) of the units 175 of the units 114 to 117 (FIGS. 10, 21, 22, 24, 25) with the aid of the switches 172 and the button 169 are set to reverse counting and occupy the initial position. The counters 232 and 233 are set in the initial position thereof by the switches 173 and 174.

By the command "Start" realized by depressing the button 167 (FIG. 14) on the control console 164, the programmed logical control unit 175 (FIG. 15) of the control unit 117 delivers a command to the drives 100 and 96 (FIG. 9*c*). The drive 100 projects the housing 99 to its utmost from the holder 98. The gripper 95 rests against the pipe 21 (or the rod 25) which is the second from the edge of the shelf and prevents it from being displaced by the spring 106, and the gripper 94 turns out to be under the extreme pipe 21 (or the rod 35). The rod of the hydraulic cylinder 101 of the drive 96, by pushing the roller follower 103 in the transverse guideways 105, displaces the slide 104 carrying the gripper 94. The latter by moving towards the gripper 95 held by the guideways 107 moves the extreme pipe 21 (or the rod 35) upwards, separating this pipe from the other pipes. When this pipe (or rod) with its outer surface comes against the gripper 95, the sensor 129 (or 130) (FIG. 7) delivers a signal indicative of the closed position of the grippers 94, 95 to the block 117 (FIG. 25), which delivers a signal to the drive 97 (FIG. 6) rotating the booms 93 of the device 57 or 58 toward the manipulator 56. At this time the following pipe 21 (or rod 35) on the storage rack 54 or 55 is released from the grip 95 (FIG. 9*c*) and rolls down to the rest 90 (FIG. 7*b*). By the signal of the sensor 125 indicative of the end of rotation of the boom 93 the unit 117 (FIG. 25) deenergizes the drive 97 (FIG. 6), and the unit 116 (FIG. 24) delivers a command to the drive 113 (FIG. 1) which closes the grippers 111. Having received a signal from the sensor 128 indicative of the clamping of the pipe 21 (or the rod 35) by the manipulator 56, the control unit 117 (FIG. 25) delivers a signal to the drives 96 and 100 (FIG. 9*b*). The drive 96 opens the grippers 94 and 95, and the drive 100 draws the housing 99 into the holder 98, whereupon from a signal of the sensor 129 or 130 (FIG. 7*b*) the control unit 117 (FIG. 25) switches on the drive 97 (FIG. 6*a*) rotating the booms 93 back to the storage rack 54 or 55 until the sensor 126 operates corresponding to the position of the upper shelf 73 of this storage rack. The signal of the sensor 129 (or 130) indicative of a release of the pipe 21 (or the rod 35) clamped by the grippers 111 of the manipulator 56 (FIG. 1) from the grippers 94 and 95 (FIG. 9) of the device 57 (or 58) is also delivered to the unit 116 (FIG. 24) by whose command the drive 112 (FIG. 1) is switched on (FIG. 1), which drive moves the slide 110 with the grippers 111 to the position in which the sensor 137 operates. In response to the latter the unit 116 (FIG. 24) deenergizes the drive 112.

When said signal from the sensor 137 and the signal from the sensor 118 (FIG. 1) arrive, which signals are indicative of the fact that the elevator 9 is in the upper position, the control unit 116 (FIG. 24) delivers a signal to the drive 109 (FIG. 1) for displacing the manipulator 56 together with the pipe 21 or the rod 35 clamped in the grippers thereof from a horizontal, non-operating position to a vertical, operating position.

When the manipulator 56 reaches the vertical position, the sensor 122 operates, which sensor delivers a signal simultaneously to the control units 114 and 116 (FIGS. 21 and 24). The unit 114 (FIG. 21) delivers a command to the drive 12 (FIG. 1), and the unit 116 (FIG. 24) deenergizes the drive 109 (FIG. 1). As a result, the elevator 9 starts moving downwards, and the manipulator 56 comes to a stop.

When the elevator 9 is being lowered, the sensor 135 moving onto the pipe 21 (or the rod 35) delivers a signal to the unit 114 (FIG. 21) deenergizing the drive 12 (FIG. 1), and to the unit 115 (FIG. 22), by whose command the drive 13 is switched on (FIG. 1) moving the tong 7 along the slide 31 to an operating position until the sensor 121 operates (FIGS. 2 and 3) delivering a signal to the units 115 (FIG. 22) and 116 (FIG. 24) about the fact that the tong 7 is in the operating position. The unit 115 (FIG. 22) deenergizes the drive 13 for transversely displacing the automatic tong 7 (FIGS. 2 and 3), and the drive 112 (FIG. 1) lowers the slide 110 with the grippers 111 clamping the pipe 21 (or the rod 35) until it comes into contact with the string 8. Due to the fact that the pipe 21 (or the rod 35) was preliminarily installed by the slide 110 with the aid of the sensor 137 to a rigidly defined position, this transverse displacement is characterized by a constant (the least possible) value. In response to the following command of the unit 115 (FIG. 22) the drive 24 is switched on for closing and opening the grippers 23 of the low-torque device 15 (FIG. 2), as is the drive 29 for closing and opening the grippers 27 of the locking device 16 of the tong 7'. The lower end of the pipe 21 is clamped by the grippers 23, and the upper end of the string 8 is clamped by the grippers 27. In the tong 7'' (FIG. 3) this command serves to switch on the drive 41, which closes the grippers 40 of the locking device 33, thereby clamping the upper end of the string 8 of rods.

Thereupon the unit 116 (FIG. 24) delivers a command to the drive 113 for closing and opening the grippers 111 of the manipulator 56 (FIG. 1). The grippers 111 get opened, thus releasing the pipe 21 (or the rod 35). In response to the signal of the sensor 128, the control unit 115 (FIG. 22) switches on the drive 25 of the low-torque device 15 (FIG. 2) or the drive 36 of the swivel head 32 (FIG. 3), with whose aid the pipe 21 (or the rod 35) is screwed into the threaded hole of the sleeve 28 disposed on the upper end of the string 8 of the pipes or rods.

Figure 22:
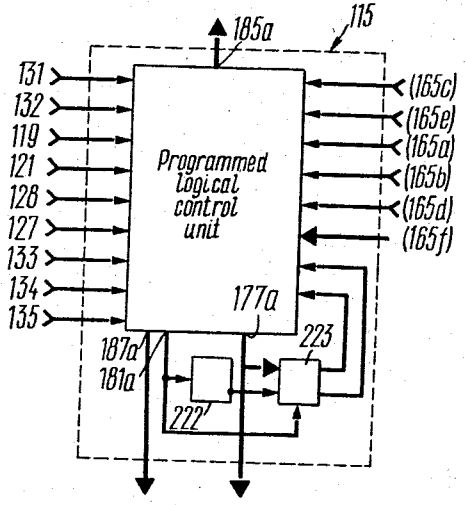
FIG. 22 is a block diagram of a control unit for controlling the automatic tong in the apparatus of the invention.

The drive 25 of the low-torque device 15 of the automatic tong 7' (FIG. 2) screws the pipe 21 until the sensor 133 operates, which sensor 133 is adjusted for a maximum torque developed by this device. In response to the sensor 133 the unit 115 (FIG. 22) deenergizes the drive 25 (FIG. 2). As a result of that command, the unit 115 (FIG. 22) switches on the drive 19 for closing and opening the grippers 18 of the high-torque device 14 (FIG. 2), whereupon the drive 20 is switched on, which drive 20 screws the screw joint to the end. The screwing procedure continues until a signal from the sensor 131 (FIG. 2) and the angle-data transmitter 132 arrives at the unit 115 (FIG. 22). The output signals from the sensors 131 and 132 (FIG. 22) are delivered to the outputs 182A of the programmed logical control unit 175 in the unit 15, which delivers a command to the drives 19, 24, and 29 (FIG. 2), thereby causing the clamping means 17, 22, and 26 to open.

If during the time preset by the timer 178 (FIG. 15) for realizing the command for tightening the screw by the high-torque device 14 (FIG. 2) one of the sensors 131 and 132 (or both) fails to operate, the signal from the timer 178 (FIG. 15) is delivered through the trigger shaper 184 and the gate 224 (FIG. 23) to the multivibrator 226 which resets the flip-flop 228 which, from the output 223*b*, switches over the unit 175 to perform a preceding command and produces a "Start" command through the output 223*a* and the trigger shaper 184 (FIG. 15), which results in unscrewing, opening of the grippers 18 (FIG. 2), and the termination of the operation of the tong 7'. A decision concerning the further operation of the tong is taken by the operator. In the rod tong 7" (FIG. 3) the tightening of the screw joint is carried out by the swivel head 32 whose torque increases, after the clearance between the turns of the screw is taken up. When this torque attains a preset maximum value, the sensor 134 operates. In response to the signal of the sensor 134 the unit 115 (FIG. 22) deenergizes the rotation drive 36 of the tong 7" (FIG. 3). If the sensor 134 does not operate in time, unscrewing takes place and the tong 7' (FIG. 2) ceases to operate in response to the command of the control signal conditioner 223 (FIGS. 22 and 23), said command being produced as described above.

Under normal conditions of the operation of the tong 7 or after eliminating all troubles after tightening the screw joint, the unit 115 (FIG. 22) energizes the drive 13 (FIGS. 2 and 3) withdrawing the tong 7 to a non-operating position (FIG. 1), which situation is indicated by the sensor 121. In response to this signal the unit 115 (FIG. 22) deenergizes the drive 13 (FIGS. 1, 2), the unit 116 (FIG. 24), and switches the drive 109 (FIG. 1), which rotates the manipulator 56 from an operating, vertical position to a non-operating position registered by the sensor 122, and the unit 114 (FIG. 21) energizes the drive 43 (FIGS. 1, 11) which closes the grippers 42 of the elevator 9.

In response to the signal of the sensor 122 (FIG. 1) the control unit 114 (FIG. 21) delivers a command to the drive 12 (FIG. 1) which raises the elevator 9, and to the drive 52 for closing and opening the grippers 50 of the spider 11. The grippers 50 open. In response to the signal of the sensor 127 indicative of the closing of the elevator 9 and the opening of the spider 11, the unit 114 (FIG. 21) produces a command to the drive 12 (FIG. 1) which lowers the elevator 9 carrying the assembled string 8 of the pipes or rods. As the elevator 9 moves downwards, the sensor 120 operates. In response to its signal the control unit 114 (FIG. 21) delivers a command to the drive 52 (FIG. 11) which closes the grippers 50 of the spider 11, whereupon the drive 43 opens the grippers 42 of the elevator 9 and in response to the signal of the sensor 127 the unit 114 (FIG. 21) delivers a command to the drive 12 which stops the elevator 9. In response to the following command the drive 12 raises the elevator 9 to a position determined by the sensor 118. In response to this sensor the drive 12 is switched off. This position of the elevator is an initial one for a subsequent cycle of operation of the apparatus.

Simultaneously with the described operation of the elevator 9 and the spider 11 there takes place loading of the manipulator 56 with another pipe 21 or rod 35 as described above.

When all the pipes 21 (or the rods 35) are taken from the upper shelf 73 of the storage rack 54 (or 55) (FIG. 7) and the number of these pipes coincides with the number preset on the control panel 165 (FIG. 14), a corresponding signal from the counter 232 (FIG. 25) through the AND gate 234 is delivered to the counter 233, which starts counting cleared shelves.

As the output signal of the counter 233 is delivered to the displacement program block 236, the latter delivers a command through the amplifier 237 to the hydraulic cylinders 78 (FIG. 8), which rotate the supports 74 of the shelf 73 by a movement opposite to that described in the part of the description relating the operation of the apparatus when raising the string of the pipes or rods to a non-operating position registered by the sensor 123 or 124, due to whose signal the unit 117 (FIG. 25) produces a command to stop rotation.

In the course of the following cycle the boom 93 of the device 57 or 58 will come to a stop in response to a signal of the sensor 126 (FIG. 7) corresponding to the level of the shelf 73 being unloaded. As the shelves 73 are cleared, they are set to a non-operating position in a manner described above, and the booms 93 of the devices 57 and 58 when turned to the storage rack 54 or 55 occupy a position on the level of the shelf being unloaded.

The above-described modification of the apparatus of the present invention relates to apparatus for underground repairs of oil and gas wells equipped with pumps. Slightly modified, such an apparatus may prove very useful for lowering and raising operations with some types of drill pipes and drill rods.

High efficiency, compactness, safety and reliability in operation as well as relatively simple construction make this apparatus economical and maneuverable. Comparatively low and stable, due to, in particular, horizontal assembling of pipes and rods in combination with the above-mentioned qualities, this apparatus can be used for operation in sea wells, which is particularly important now, when so much attention is given to this type of oil production.

While particular embodiments of the invention have been shown and described, various modifications thereof will be apparent to those skilled in the art and therefore it is not intended that the invention be limited to the disclosed embodiments thereof and the departures may be made therefrom within the spirit and scope of the invention as defined in the claims.

What is claimed is:

1. An automated apparatus for handling elongated well elements such as pipes, made up into a pipe string by means of screw joints, which comprises:

a first base;

a derrick mounted on said first base;

elevator means for suspending a pipe string mounted on said derrick and for vertical movement, said elevator means including gripping means and drive means for closing and opening said gripping means;

driving means to move said elevator means vertically for suspending a pipe string and mounted on said first base;

suspending means for suspending a pipe string immovably mounted above a well head and below said elevator means, said suspending means including gripping means and drive means for closing and opening said gripping means;

an automated tong for screwing and unscrewing a pipe string, said tong being mounted upon said first base between said elevator means and suspending means and for transverse movement relative to a pipe string and including drive means for rotating a pipe element;

a second base mounted adjacent but spaced from said first base;

manipulator means mounted on said second base for movement so that a pipe element clamped thereby can be aligned with a pipe string, said manipulator means including gripping means mounted for longitudinal movement relative to said manipulator means, drive means for closing and opening said gripping means, and drive means for longitudinal movement of said gripping means relative to said manipulator means;

a rack for storing string elements in a horizontal position and mounted on said second base, said rack including:

substantially vertical columns mounted on said second base;

shelves mounted on said columns and vertically spaced above one another;

drive means for moving said shelves;

transfer means for transferring a string element from said rack into said manipulator means and back, said transfer means mounted on said second base and comprising:

at least one boom mounted on said second base for pivoting movement in a vertical plane;

gripping means mounted on said boom for holding a string element;

drive means for closing said gripping means;

drive means to pivotally move said boom;

control means including:

a plurality of electronically controlled actuator means for actuating said transfer means, said drive means to pivotally move said boom, and said drive means for closing and opening said gripping means of said manipulator means, of said automatic tong, of said elevator means and suspending means for suspending a pipe string, and of said transfer means for transferring well elements;

position sensing means mounted on said transfer means for sensing the position of said boom and for providing one of two signals: "approached" corresponding to the position of said boom as it approaches the manipulator means or "withdrawn" corresponding to stopping said boom in a preset position for transferring a string element to said manipulator means and gripping a string element by said manipulator means;

position sensing means mounted on said shelves for sensing positions of said shelves of said rack and for providing one of two signals: "approached" corresponding to the position of the shelves for loading string elements, or "withdrawn" corresponding to moving said shelves away from said loading position and to stopping said shelves in a preset position;

control means comprising at least one programmed logical control means connected with said actuating means of said plurality of electrically controlled actuating means and wherein said programmed logical control means further comprises:

an instruction coding means for specifying a sequence of instructions to be sent to respective control means in accordance with a preset sequence of operation;

a timer for generating a signal at the end of a time preset by a code of instructions produced by said instruction coding means;

a recycle counter electrically connected with said timer of said programmed logical control means to generate a signal upon receiving an output signal from said programmed logical control means indicative of the termination of a preset time from the moment of the generation of an instruction for switching on of said drive means for rotating said automatic tong;

a control signal conditioner electrically connected with said timer, with said instruction coding means of said programmed logical control means, and with said recycle counter to generate and send to said programmed logical control means, in an amount preset by said recycle counter, instructions for reversing and for restarting said instruction coding means in the original counting direction;

a string element counter electrically connected with said instruction coding means of said programmed logical control means for generating a signal at the moment when the number of string elements taken from a desired shelf of said rack or stored on said shelf reaches a preset amount defined by the capacity of said shelf; and counting means for counting said shelves of said rack and electrically connected with said counter for string elements and for supplying to a respective corresponding drive means an instruction to move a required one of said shelves into the position for loading and to withdraw it from said position for loading, and for switching off said programmed logical control means at the moment when all said shelves of said rack are fully loaded and at the moment when all said shelves of said rack are empty.

2. An automated apparatus for handling elongated well elements, such as pipes, made up in a string by means of screw joints, comprising:

a derrick;

elevator means for suspending a string and mounted on said derrick for vertical movement, said elevator means including gripping means and drive means for closing and opening said gripping means;

drive means for vertically moving said elevator means;

suspending means for suspending a drill string and immovably mounted above a well head and below said elevator means and including gripping means and drive means for closing and opening said gripping means;

an automatic tong for screwing and unscrewing a drill string, mounted between said elevator means and said suspending means, and including drive means for transversely moving said automatic tong toward and away from the drill string;

a manipulator having an axis and mounted for movement so that a drill string clamped thereby can be axially aligned with a well bore, said manipulator comprising gripping means mounted for movement along the axis of said manipulator, drive means for closing and opening said gripping means, drive means for longitudinal movement of said gripping means, and drive means for moving said manipulator toward and away from said derrick;

control means comprising:

a plurality of electrically controlled actuating means for acting upon said drive means for vertically moving said elevator means, drive means for closing and opening said gripping means of said manipulator, of said automatic tong, of said elevator means and of said suspending means;

control means comprising at least one programmed logical control means connected with said actuating means;

a first well element position sensor mounted on said elevator means and electrically connected through said programmed logical control means to said actuating means which actuate said drive means for vertically moving said elevator means, said drive means for transversely moving said automatic tong, and said drive means for closing and opening said gripping means of said elevator means;

a second well element position sensor for sensing the position of a well element mounted on said automatic tong and electrically connected through said programmed logical control means to said actuating means which actuate said drive means for vertically moving said elevator means;

a third well element position sensor for sensing the position of a well element mounted on said manipulator and electrically connected through said programmed logical control means to said actuating means for actuating said drive means for longitudinally moving said gripping means of said manipulator; and wherein all said drive means are hydraulically operated and form part of a hydraulic system including a source of pressurized fluid, a delivery line, and a drain line, and said actuating means of said plurality of electrically controlled actuating means are reversible spool valves for controlling the supply of pressurized fluid from said source of pressurized fluid to said hydraulically operated drive means, said hydraulic system comprising a normally closed stop valve installed in a delivery line connecting the source of pressurized fluid with a reversible spool valve acting upon said drive means for closing and opening said gripping means of said elevator means, while said drive means for closing and opening said gripping means of said means for suspending a drill string includes a stop mechanically interacting with said stop valve so that with the gripping means of said suspending means being open said stop valve shuts off the pressure line from a spool valve controlling said drive means for closing and opening said gripping means of said elevator means, thus preventing the gripping means thereof from being moved apart.

* * * * *